US006302519B1

(12) United States Patent
Fukuda et al.

(10) Patent No.: US 6,302,519 B1
(45) **Date of Patent: *Oct. 16, 2001**

(54) INK-JET TEXTILE PRINTING METHOD AND APPARATUS THEREFOR

(75) Inventors: Shizuko Fukuda, Kawasaki; Toshio Kashino, Chigasaki; Yoshie Asakawa, Nagano, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/893,490

(22) Filed: Jul. 11, 1997

(30) Foreign Application Priority Data

Jul. 12, 1996 (JP) ..... 8/183650
Jul. 9, 1997 (JP) ..... 9/183712

(51) Int. Cl.[7] ..... B41J 2/21; B41J 2/05; B41J 2/01

(52) U.S. Cl. ..... 347/43; 347/65; 347/101

(58) Field of Search ..... 347/65, 43, 101

(56) References Cited

U.S. PATENT DOCUMENTS

| | | | |
|---|---|---|---|
| 5,278,585 | 1/1994 | Karz et al. | 347/65 |
| 5,467,112 | 11/1995 | Matani | 347/1 |
| 5,606,351 | 2/1997 | Hawkins | 347/15 |
| 5,821,962 * | 10/1998 | Kudo et al. | 347/65 |

FOREIGN PATENT DOCUMENTS

| | | | |
|---|---|---|---|
| 640479 * | 3/1995 | (EP) . | |
| 0 640 479 | 3/1995 | (EP) . | |
| 0 646 460 | 4/1995 | (EP) . | |
| 0 655 337 | 5/1995 | (EP) . | |
| 0 816 088 | 1/1998 | (EP) . | |
| 0 819 529 | 1/1998 | (EP) . | |
| 62-57750 | 12/1987 | (JP) | D06P/5/00 |
| 63-31594 | 6/1988 | (JP) . | |
| 7-117223 | 5/1995 | (JP) | B41J/2/01 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

The present invention provides an ink-jet textile printing method and an ink-jet textile printing apparatus, which can reduce number of ink-jet head than that in the prior art, and can stably perform ink ejection and printing when an ink-jet textile printing is performed for a cloth of blended yarn fabric of two or more fibers. The ink-jet textile printing method according to the present invention, includes employing a liquid ejection head having a first liquid passage communicated with an ejection port, a second liquid passage having a bubble generating region for generating bubble in a liquid by applying a heat for the liquid, and a movable member disposed between the first liquid passage and the bubble generating region, having a free end on the ejection port side, and displacing the free end toward the first liquid passage side in response to a pressure generated by bubble within the bubble generating region for orienting the pressure toward the ejection port side of the first liquid passage, step of supplying a first textile ink in the first liquid passage; step of supplying a second textile ink in the second liquid passage, and step of heating and bubbling the second textile ink supplied to the second liquid passage for ejected through the ejection port together with the first textile ink supplied to the first liquid passage.

29 Claims, 28 Drawing Sheets

INK-JET TEXTILE PRINTING METHOD AND APPARATUS THEREFOR

BACKGROUND OF THE INVENTION

1. Field of the Invention

The present invention relates to an ink-jet textile printing method and an ink-jet textile printing apparatus, for forming an image by ejecting a textile ink on a cloth. More specifically, the invention relates to an ink-jet textile printing method and an ink-jet textile printing apparatus, which is suitable for a blended yarn fabric of at least two kinds of fibers.

2. Description of the Related Art

As typical conventional textile printing apparatus, apparatus employing roller textile printing method, screen textile printing method have been known. The roller textile printing method is a method to form a continuous pattern by pressing a roller engraved a pattern onto a cloth. The screen textile printing method is a method to directly printing on a cloth and so on by using screen printing plates which are set up gauzes and film plates in screen frames respectively, the number of those screen printing plates corresponds to number of colors and patterns to be overlaid.

In the textile printing apparatus employing such roller textile printing method or the screen textile printing method, a large number of process steps and days are required for preparing the rollers or the screen printing plates. They also require blending of respective colors of inks to be used for printing, operation for registering the roller or the screen printing plates, and so on. Furthermore, the scale of the apparatus is large. According to increasing of number of colors to be used, number of the necessary rollers or screen printing plates are proportionally increased and the scale of the apparatus is further increased, as a result relatively large space for installation require. Furthermore, at every occasion of changing of the image to be printed, the rollers or the screen printing plates are changed. Then, the rollers or the screen printing plates removed from the apparatus has to be stored in view of re-use toward the future. Therefore, storage space for such rollers or screen printing plates becomes necessary.

An ink-jet type printing apparatus has been put into practice as a printing device to be employed in a printer, a copy machine, a facsimile or the like, or as a printer to be used as an output device for composite type electronic apparatus including a computer, wordprocessor and the like or a workstation. Such ink-jet type printing apparatus for textile printing to perform printing by ejecting an ink directly on a cloth have been proposed in Japanese Patent Application Publication No. 62-57750 (1987) and Japanese Patent Application Publication No. 63-31594 (1988).

An ink-jet textile printing method for a cloth, in which two or more kinds of fibers are blended has been proposed in Japanese Patent Application Laid-open No. 7-117223 (1995). In this method, dyeing is performed by preparing ink-jet heads to which textile inks corresponding to respective fibers is supplied. For example, when ink-jet textile printing is to be performed for a blended cloth of cotton and polyester, an ink-jet head supplied a textile ink containing a water-soluble dye, such as direct dye, acid dye or the like having dyeability for cotton, and an ink-jet head supplied a textile ink containing a disperse dye having dyeability for polyester are employed.

When ink-jet textile printing is performed for an unblended cloth, three kinds of ink-jet heads become necessary even if textile inks of three primary colors, i.e., yellow, magenta and cyan, as used in general color printing. In case of the blended cloth, in which two kinds of fibers are mixed, six kinds of ink-jet heads become necessary. When special colors, such as black, green, orange or the like are additionally used, double of six kinds of ink-jet heads corresponding to the textile inks of yellow, magenta, cyan, black, green and orange, namely twelve kinds of ink-jet heads become necessary. Furthermore, in order to prevent color drift which occurs when overlaying order of the inks is reversed in a backward scanning, i.e. for one reciprocal scanning in serial system, further double, i.e. twenty-four kinds of ink-jet heads become necessary.

In the conventional ink-jet textile printing method for the cloth, in which two or more kinds of fibers are blended, it becomes necessary to use textile inks having different physical property depending upon kinds of the fibers. Therefore, quite large number of kinds of ink-jet heads have to be provided. In the ink-jet printing, it has been known that it is effective to provide a recovery mechanism for recovering ejecting condition of the ink-jet head in order to maintain good ejecting condition. The recovery mechanism is provided for each ink-jet head or for every kinds of heads. Including such recovery mechanism of the ink-jet head, the system becomes quite complicate.

In case of a textile ink unstable for heat, such as the textile ink containing disperse dye, and in case of the bubble-jet type ink-jet system which supplies an electric power to a heater facing a liquid passage for heating to eject the ink by bubbling of the ink, stable ejection or printing is difficult. The reason is that there is the tendency such that contaminant may deposit on the surface of the heater by using the textile ink containing disperse dye, thermal denatured substance of the ink may be stagnated in the liquid passage extending from the heater to ejection port, or viscosity of the textile printing ink is increased.

SUMMARY OF THE INVENTION

It is an object of the present invention to provide an ink-jet textile printing method and an ink-jet textile printing apparatus, which requires smaller number of ink-jet heads than that in the prior art when ink-jet textile printing is performed for a cloth, in which two or more fibers are blended.

Another object of the present invention is to provide an ink-jet textile printing method and an ink-jet textile printing apparatus, which can stably perform ink ejection and printing.

An ink-jet textile printing method according to the present invention, comprises;

employing a liquid ejection head having a first liquid passage communicated with an ejection port, a second liquid passage having a bubble generating region for generating bubble in a liquid by applying a heat for the liquid, and a movable member disposed between the first liquid passage and the bubble generating region, having a free end on the ejection port side, and displacing the free end toward the first liquid passage side in response to a pressure generated by bubble within the bubble generating region for orienting the pressure toward the ejection port side of the first liquid passage;

step of supplying a first textile ink in the first liquid passage;

step of supplying a second textile ink in the second liquid passage; and step of heating and bubbling the second textile ink supplied to the second liquid passage for ejected through the ejection port together with the first textile ink supplied to the first liquid passage.

In the ink-jet textile printing method according to the present invention, it is desirable that the second textile ink is thermally more stable than that of the first textile printing ink. When the cloth is a blended yarn fabric of at least two kinds of fibers, the first textile ink preferably corresponds to the fiber having a higher blending ratio among the fibers forming the cloth. The cloth may be a blended yarn fabric of cotton and polyester, for example. In this case, it is effective that the first textile ink contains a disperse dye and the second textile ink contains a water-soluble dye.

Furthermore, a part of generated bubble may be extended in the first liquid passage associating with displacement of the movable member. The bubble may have a state contacting with the movable member during displacement of the movable member.

A heater for heating the second textile ink so as to generate bubble may be provided in opposition to the movable member, and the bubble generating region may be located between the heater and the movable member. In this case, the free end may be positioned at downstream side of flow of the first textile ink from a center of the area of the heater. The bubble may be generated by film boiling which cause in the second textile ink by transmitting a heat generated by the heater to the second textile printing ink. It is desirable, the second textile ink may supplied along substantially flat or smooth inner peripheral surface at upstream side of the heater on the heater. An entire effective bubbling region of the heater may oppose the movable member. An entire surface of the heater may oppose the movable member. A fulcrum of the movable member may be not positioned right above the heater. It is effective that the free end of the movable member is arranged on the ejection port side than the heater.

An ink-jet printing apparatus for forming an image on a printing medium by ejecting an ink according to the present invention, comprises:

first and second liquid passages corresponding to an ejection opening for ejecting the ink;

a liquid ejection head constructed to eject a first ink supplied to the first liquid passage and a second ink supplied from the second liquid ejecting process step through a common ejection opening; and mixture ratio control means for controlling a mixture ratio of the first ink to the second ink to be ejected from the ejection opening of the printing head.

According to the present invention, textile printing of image can be constantly done stably without paying substantial attention for blending ratio, for cloth, particularly a blended yarn fabric, e.g. fiber such as polyester which must be printed by aqueous ink containing disperse dye unstable against heat, and fiber such as cotton which can be printed by the aqueous ink containing a water-soluble dye. Although textile printing in the past must use a plurality of heads for printing on the blended cloth, textile printing according to the present invention can be done with one kind of ink-jet head to be able to form a quite simple textile printing system.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to be present invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

Figure 1:
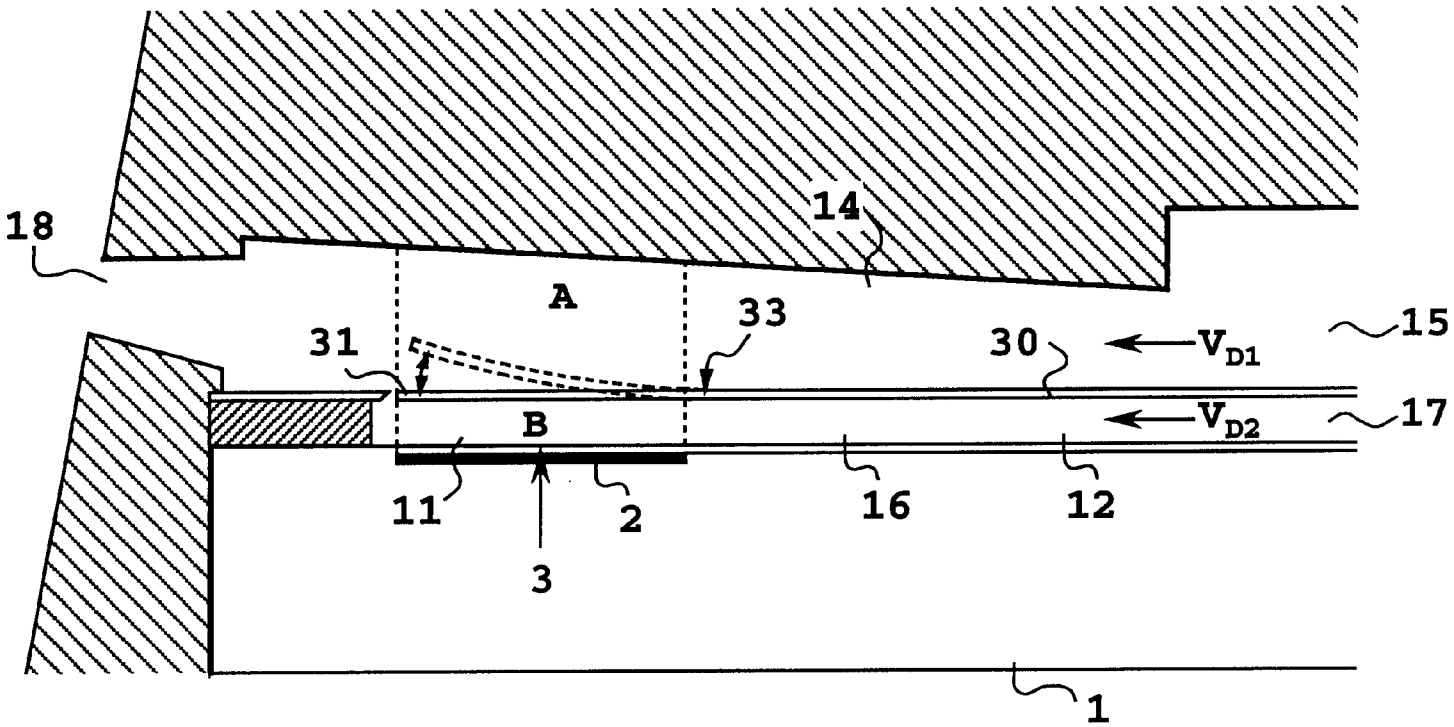
FIG. 1 is a section showing one embodiment of a liquid ejection head which can implement the present invention.
Figure 2:
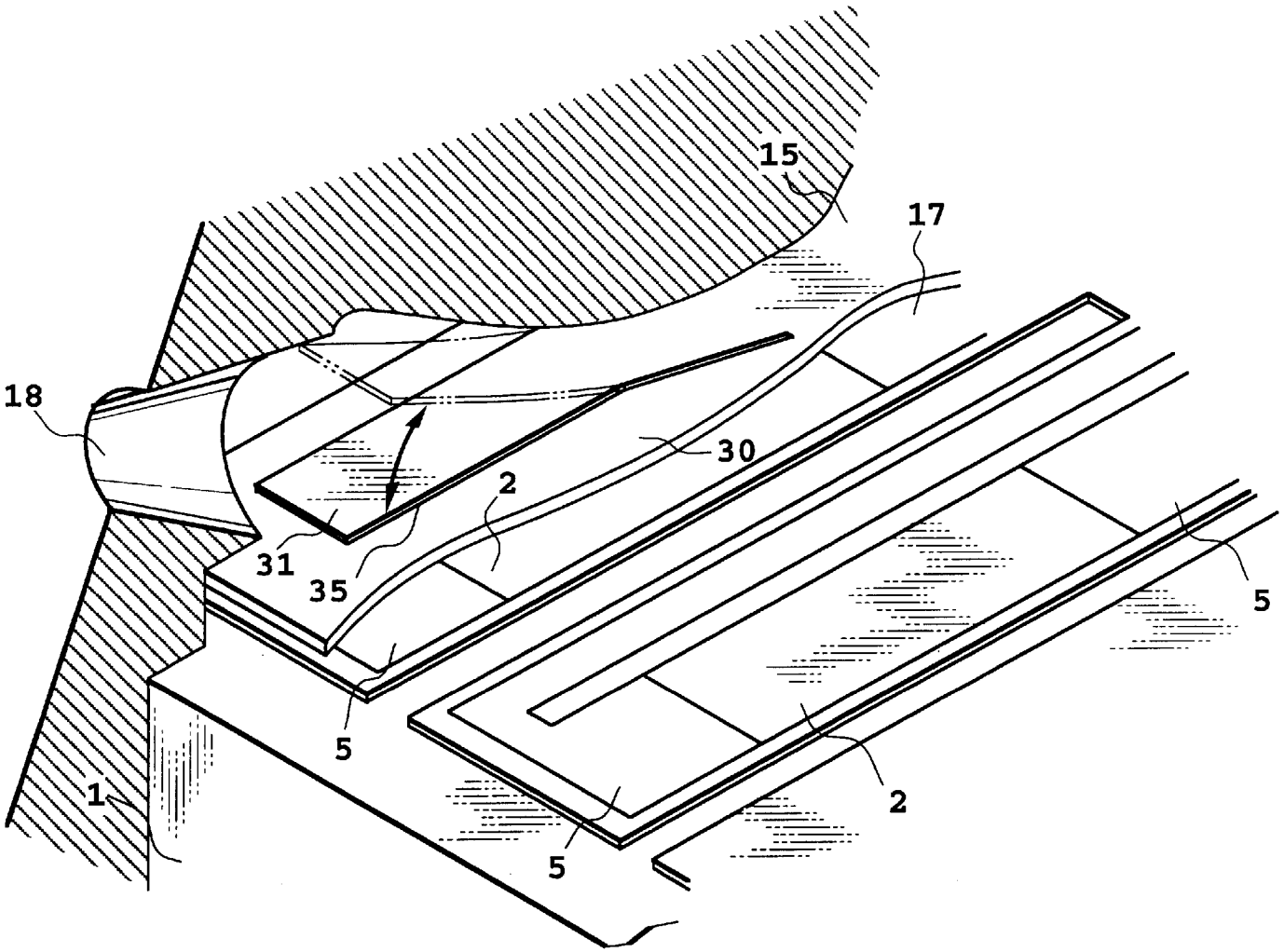
FIG. 2 is a partially sectional perspective view of the liquid ejection head of FIG. 1.

FIG. 1 is a diagrammatic section of one example a direction of a flow passage of a liquid ejection head to be used upon implementing the present invention. FIG. 2 is a partially sectional perspective view of the liquid ejection head.

The present embodiment of the liquid ejection head is constructed with the second liquid passage 16 for generating bubble in the second textile ink is arranged on the element substrate 1, in which the heater 2 for providing thermal energy for generating bubble in the second textile ink, the first liquid passage 14 for the first textile ink in direct communication with the ejection port 18 is arranged over the second liquid passage 16.

The upstream side of the first liquid passage 14 is communicated with the first common liquid chamber 15 for supply the first textile ink to a plurality of the first liquid flow passage 14, and the side of the second liquid passage 16 at the upstream, is communicated with a second common liquid chamber for supply the second textile ink 17.

Between the first and second liquid passages 14 and 16, a separation wall 30 formed of a material having elasticity, such as metal to separate the first and second liquid passages 14 and 16.

The separation wall 30 at a portion located within the space where the in-plane direction of the heater 2 may be projected upwardly (corresponding to the region of A and the bubble generating region 11 of B in FIG. 1, hereinafter referred to as ejection pressure generating region), forms the movable member 31 in cantilever fashion. The movable member 31 has free end on the side of the ejection port 18 (on the downstream side of flow of the textile ink) by a slit 35 and has a fulcrum 33 on the side of the common liquid chambers 15 and 17. The movable member 31 is arranged to face toward the bubble generating region 11(B). Then, the movable member 31 is operated to open toward the ejection port 18 on the side of the first passage 14 (in the direction of arrow in the drawing) by bubbling of the second textile ink. Even with FIG. 2, it should be appreciated that the separation wall 30 is arranged via the space forming the second passage 16 on the element substrate 1, on which the heating resistor portion (electrothermal transducer) as the heater 2 and the wiring electrode 5 for applying the electric signal to the heating resistor portion are formed.

The movable member 31 has the fulcrum (fulcrum portion: fixed end) on the upstream side of the large flow flowing toward the ejection port 16 from the common liquid chamber 15 via the movable member 31 by ejecting the textile ink. The movable member 31 is arranged in spaced about 15 $\mu$m apart from the heater 2 to have the free end (free end portion) 32 on downstream side with respect to the fulcrum 33, and to cover the heater 2 in opposition to the heater 2. The bubble generating region is defined between the heater 2 and the movable member 31. For such construction, upon bubbling as set forth above, the function or effect to orient the propagating direction or growing direction of the bubble toward the ejection port 18, can be efficiently realized. Furthermore, positional relationship set forth above achieves not only the performance or effect for ejection but also the effect to reduce flow resistance for respective textile inks flowing through the liquid passages 14 and 16 to achieve high speed re-fill.

Providing supplementary explanation, in the shown embodiment of FIG. 1, the free end 32 of the movable member 31 is extended with respect to the heater 2 so that it is opposite to the downstream side than the area center 3 (a line extending perpendicular to longitudinal direction of the liquid passages through the center of the heater 2) dividing the heater 2 into an upstream side region and a downstream side region). Thereby, the movable member 31 may be subject to a pressure or bubble generated on the downstream side than the area center position 3 of the heater 2, which significantly contribute for ejection of the textile ink to orient the pressure or bubble toward the ejection port 18 side to ultimately improve ejection efficiency or ejection force.

The kinds, shapes or arrangements of the heater 2 and the movable member 31 are not limited to those illustrated in the shown embodiment but can be of any shape and arrangement which can control growth of bubble or pressure as will be explained later.

The second liquid passage 16 in the shown embodiment includes the supply passage 12 having the internal periphery to be continues in substantially flush (the surface of the heater 2 is not dropped significantly), with the heater 2, on the upstream side of the heater 2. In such case, supply of the second textile ink into the bubble generating region 11 and the surface of the heater 12 is performed as illustrated by $V_{D2}$ along the surface of the movable member 31 on the side close to the bubble generating region 11 of the movable member 31. Therefore, stagnation of the second textile ink on the surface of the heater 11 can be restricted to facilitate removal of residual bubble caused by precipitation of gas dissolved in the second textile ink or failure of quenching of the bubble. Also, heat accumulated in the second textile ink may not become excessive. Accordingly, stable bubble generation can be repeated at high speed.

While the shown embodiment is described the supply passage 12 having substantially flat inner peripheral wall, the shape of the supply passage is not limited to that described but can be of any shape as long as it smoothly continued with the surface of the heater 2 and has moderate inner peripheral wall so as not to cause stagnation of the textile ink on the heater 2 or significant disturbance of supply of the ink.

Next, operation of the shown embodiment of the liquid ejection head will be described with reference to FIG. 3.

Upon driving of the head, as the first textile ink supplied to the first liquid passage 14 and the second textile ink supplied to the second liquid passage 16, the inks having mutually different properties are employed.

The heat generated by the heater 2 acts on the second textile ink within the bubble generating region of the second liquid passage, bubble 40 is generated in the second textile ink through film boiling as disclosed in U.S. Pat. No. 4,723,129.

In the present embodiment, bubbling pressure may never escape through three directions except for the upstream side of the bubble generating region. Therefore, the pressure associated with generation of the bubble is concentrically transmitted on the side of the movable member 31 arranged in the ejection pressure generating portion to cause displacement of the movable member 31 from the condition of FIG. 3A toward the first liquid passage 14 side as shown in FIG. 3B. By this action of the movable member 31, the first and second liquid flow passages 14 and 16 are communicated with wide path area so that the pressure generated by bubbling is mainly transmitted in the direction toward the ejection port (direction A) of the first liquid passage 14. By this pressure transmission and mechanical displacement of the movable member as set forth above, the liquid is ejected through the ejection port.

Figure 3A:
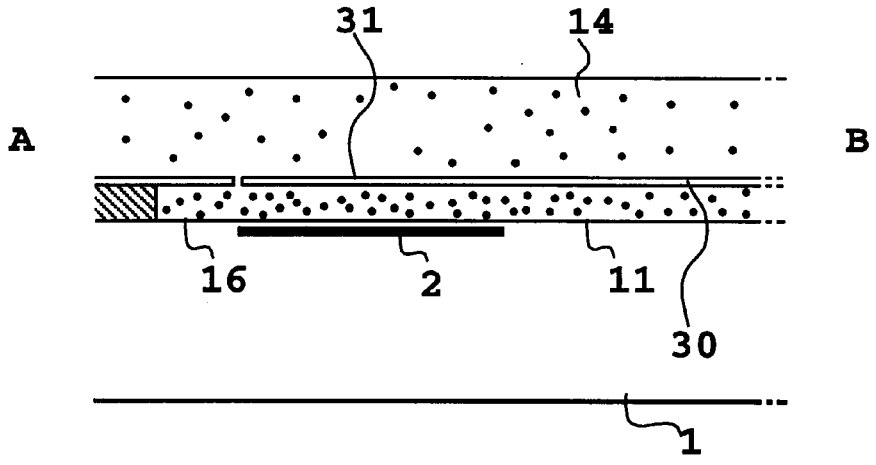
FIGS. 3A and 3B are conceptual illustrations for explaining operation of a movable member.
Figure 3B:
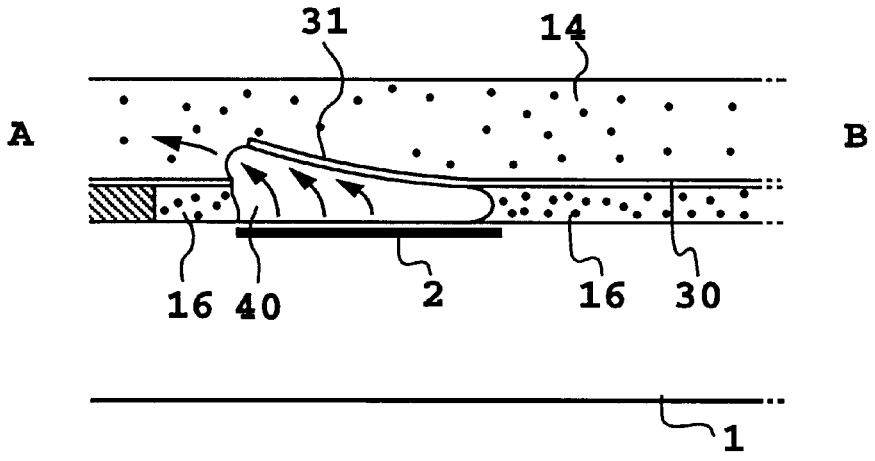

Next, according to shrinking of the bubble, the movable member 31 returned to the position of FIG. 3A. In conjunction therewith, the first textile ink in amount corresponding to the amount of the ejected first textile ink is supplied from the upstream side in the first liquid passage 14. Since supply of the first textile ink is performed in the direction of closing the movable member 31, re-fill of the ejection liquid may not be obstructed by the movable member 31.

With the construction of the foregoing embodiment, the first textile ink may be ejected by the pressure generated by bubbling of the second textile ink. Therefore, even with high viscous liquid which is difficult to generate sufficient bubble and can generate insufficient ejection force in the prior art, it becomes possible to obtain satisfactory ejection by supplying the textile ink having good bubbling characteristics or the textile ink having low boiling point to the second liquid passage.

By selecting a textile ink which does not cause deposit, such as torrid or the like on the surface of the heater 2 even in subjecting a heat, as the second textile ink, bubbling becomes stable to obtain satisfactory ejection.

Even in the case of the textile ink weak in the heat, high efficiency and high ejection force of such textile ink can be done by supplying such textile ink to the first liquid passage 14 as the first textile ink, and by supplying a second textile ink which is difficult to cause alternation of property due to heat and can easily generate bubble, to the second liquid passage 16, without causing adverse effect.

<Other Embodiments>

The embodiments of the major portion of the liquid ejection head and the liquid ejection method according to the present invention, has been explained. Hereinafter, some applicable desirably embodiments to the embodiments will be explained with reference to the drawings.

<Ceiling Configuration of Liquid Flow Passage>

Figure 4:
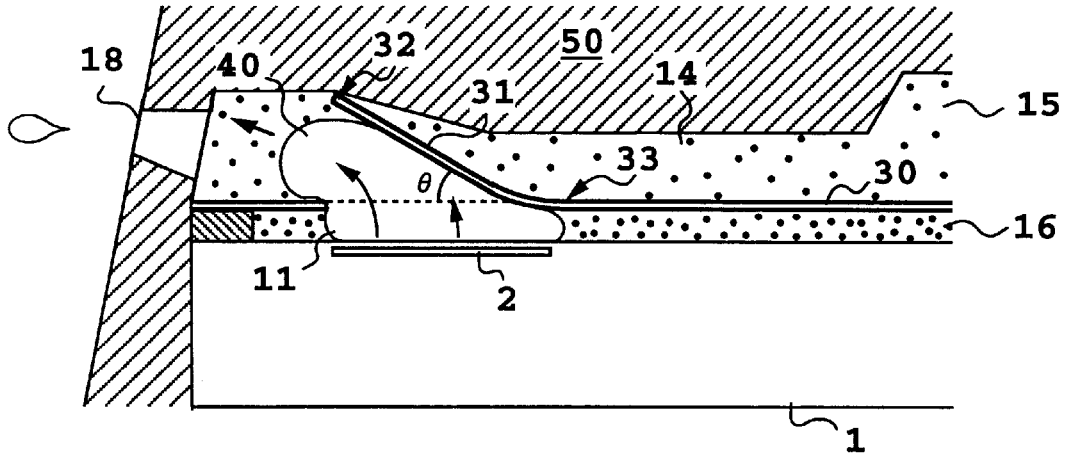
FIG. 4 is a conceptual illustration for explaining a structure of the movable member and a first liquid passage.

FIG. 4 is a sectional view in the liquid flow passage direction of the liquid ejection head of the present invention. A grooved member 50 having a groove defining the first liquid passage 14 (or the liquid passage 10 in FIG. 1), is arranged above the separation wall 30. In the present embodiment, the height of the ceiling or an upper plate of the liquid passage in the vicinity of the position of the free end of the movable member 31 is high to provide greater operation angle θ of the movable member 31. The operation range of the movable member 31 may be determined with taking the structure of the liquid flow passage, durability of the movable member 31, bubbling force and so on. It is desirable that the operation range of the movable member 31 permits operation up to the angle including the axial direction of the ejection port 18.

As shown in this figure, by proving greater high of the displacement of the free end of the movable member 31 than the diameter of the ejection port 18, further sufficient ejection force can be transmitted. Also, as shown in this figure, since the height of the upper plate of the liquid passage at the position of the fulcrum 33 of the movable member 31 is lower than the height of the upper plate of the liquid passage at the position of the free end 32 of the movable member 31, surge of the pressure wave toward the upstream side can be further effectively prevented.

<Positional Relationship between Second Liquid Flow Passage and Movable Member>

Figure 5A:
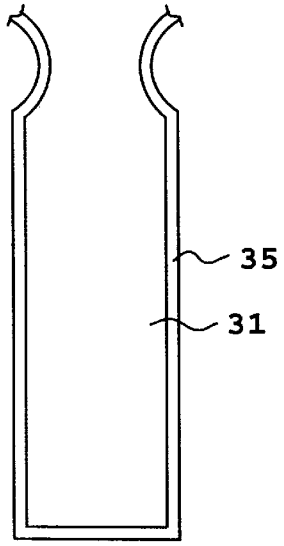
FIGS. 5A to 5C are conceptual illustrations for explaining structures of the movable member and liquid passage.
Figure 5B:
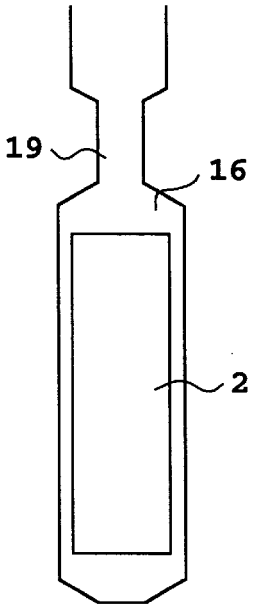
Figure 5C:
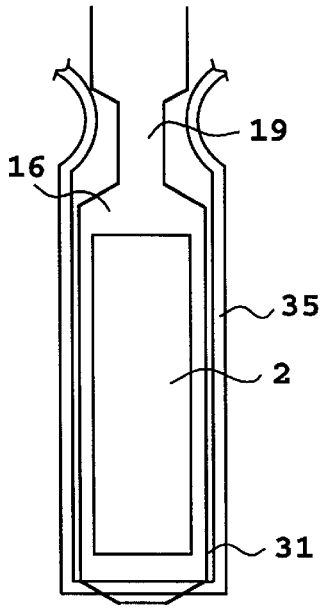

FIG. 5 is illustration for explaining positional relationship between the above mentioned movable member 31 and the second liquid passage 16. FIG. 5A is an illustration of the portion in the vicinity of the separation wall 30 and the movable member 31 as viewed from the above, FIG. 5B is an illustration showing the second liquid passage 15 with removing the separation wall 30, as viewed from the above, and FIG. 5C is an illustration showing positional relationship of the movable member 31 and the second liquid passage 16 as illustrated diagrammatically by overlapping respective elements. In all figures, lower side in the drawings are the front face side where the ejection port 18 arranged.

The second liquid passage 16 of the present embodiment has a narrowed portion 19 at the upstream side of the heater 2 (here, upstream side means the upstream side in the flow from the second common liquid chamber to the ejection port 18 via the heater 2 position, the movable member 31 and the first liquid passage) to define a chamber structure (bubbling chamber) which successfully prevent the pressure generated by bubbling from easily escaping toward the upstream side of the second liquid passage 16.

In conventional case of the head where the liquid passage of bubbling and the liquid passage for ejecting the liquid are common and the narrowed portion 19 is provided to prevent the pressure generated at the liquid chamber side of the heater 2 from escaping, it was necessary to take a constriction, in which the liquid passage sectional area in the narrowed position 19 is not too small in view of re-fill of the liquid.

However, in the present embodiment, large proportion of the textile ink to be ejected is the first textile ink in the first liquid passage 14, and the second textile ink in the second liquid passage 16 where the heater is provided, is not consumed in significant amount. Therefore, re-fill amount of the second textile ink to the bubble generating region 11 of the second liquid passage 16 can be small.

Accordingly, the distance in the narrow portion 19 can be quite small in the extent of several μm to ten-odd ten μm. Therefore, the pressure generating in the second liquid flow passage during bubbling can be restricted from escape to the circumference to concentrically direct to the movable member 31. Since this pressure can be used as ejection force via the movable member 31, higher ejection efficiency and higher ejection force can be achieved. The configuration of the first liquid passage 16 is not limited to the foregoing construction, and can be of any shape, through which the pressure generated by bubbling can be effectively transmitted to the movable member 31 side.

As shown in FIG. 5C, the side portion of the movable member 31 covers a part of the wall forming the second liquid passage. Thereby, dropping down of the movable member 31 into the second liquid passage is successfully prevented. This enhances separation between the first textile ink and the second textile ink to improve the ejection pressure and the ejection efficiency. Also, it becomes possible to perform re-fill from the upstream side by utilizing the negative pressure upon extinction of bubble.

In FIGS. 3B and 4, associating with displacement of the movable member 31 toward the first liquid passage 14 side, a part of the bubble generated in the bubble generating region of the second liquid passage 16 extends into the first liquid passage 14, by selecting height of the second liquid passage so that the bubble extends into the first liquid passage 14, the ejection force can be improved in comparison with the case where the bubble may not extend into the first liquid passage. In order to extend the bubble into the first liquid passage 14, it is desirable to set the height of the second liquid passage 16 smaller than the maximum diameter of the bubble. Preferably, the height may be set within a range of several μm to 30 μm. In the present embodiment, this height is set at 15 μm.

<Movable Member and Separation Wall>

Figures 6A, 6B, 6C:
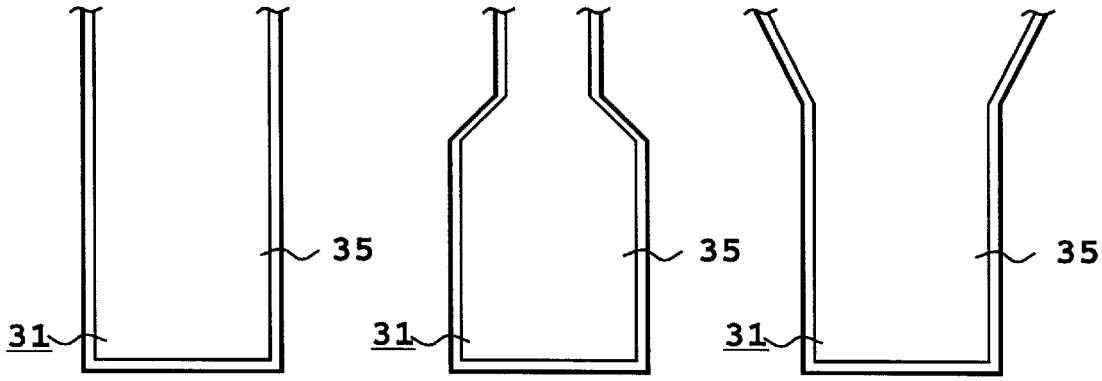
FIGS. 6A to 6C are conceptual illustrations for explaining another shapes of the movable member.

FIG. 6 shows another configurations of the movable members 31, in which the reference numeral 35 denotes a slit provided in the separation wall, and by this slit, the movable member 31 is formed. In these figures, FIG. 6A shows a rectangular shaped configuration, FIG. 6B shows the configuration, in which the fulcrum side is formed narrower to facilitate operation of the movable member 31, and FIG. 6C shows the configuration, in which the fulcrum side is wider for improving durability of the movable member 31. As the configuration achieving easiness of operation and reasonable durability, the configuration having a narrowed portion with semicircular cut-outs at the fulcrum side as illustrated in FIG. 5A is desirable. However, the configuration of the movable member 31 is only required not to enter into the second liquid passage side, easily operated and achieves high durability.

In the former embodiment, the plate form movable member 31 and the separation wall 30 having the movable member 31 is formed with a nickel of 5 μm thick. However, as the material of the movable member 31 and the separation wall, any material which has sufficient resistance to solvent against the textile ink, sufficient elasticity for satisfactory operation, and sufficient workability for permitting formation of fine slit.

As material usable for the movable member 31, it is desired to be selected from the materials having high durability, consisting of metal, such as silver, nickel, gold, iron, titanium, aluminum, platinum, tantalum, stainless steel, phosphor bronze or the like, alloy metals thereof, resin containing nitrile group, such as acrylonitrile, butadiene, styrene or the like, resin containing amide group, such as polyamide or the like, alloy metals thereof, resin containing carboxyl group, such as polycarbonate or the like, resin having aldehyde group, such as polyacetal or the like, resin containing sulfone group, such as polysulfone, other resin, such as liquid crystal polymer or the like, and compounds thereof, metal having high ink resistance, such as gold, tungsten, tantalum, nickel, stainless steel, titanium or the like, alloy thereof, one coated on the surface with respect to the ink resistance, resin having amide group, such as polyamide or the like, resin having aldehyde group, such as polyacetal or the like, resin containing ketone group, such as polyether ether ketone or the like, resin containing imide group, such as polyimide or the like, resin containing hydroxyl group, such as phenol or the like, resin containing ethyl group, such as polyethylene or the like, resin having alkyl group, such as polypropylene, resin having epoxy group, such as epoxy resin or the like, resin containing amino group, such as melamine formaldehyde resin, methylol group, such as xylene resin or the like, and their compound, and ceramic, such as silicon dioxide and compounds thereof.

As a material usable for the separation wall, resin having high heat resistance, solvent resistance, molding ability typically represented by recent engineering plastic, such as polyethylene, polypropylene, polyamide, polyethylene terephthalate, melamine resin, phenol resin, epoxy resin, polybutadiene, polyurethane, polyether ether ketone, polyether sulfone, polyarylate, polyimide, polysulfone, liquid crystal polymer (LCP) or so forth or their compound, silicon dioxide, silicon nitride, metal, such as nickel, gold, stainless steel or the like and alloy metals thereof, or one provided coating of titanium or gold.

The thickness of the separation wall may be determined in consideration of the material and shape or so forth in viewpoint of strength as the separation wall or good operation as the movable member 31, and is desirably 0.5 μm to 10 μm.

The width of the slit 35 for forming the movable member 31 is set at 2 μm in the present embodiment.

In the present invention, as the movable member 31, the thickness in the order of μm (t μm) is intended and not the thickness in the order of cm. For the movable member 31 of the thickness in the order of μm, it is desirable to consider certain extent of fluctuation in fluctuation in the case of slit width in the order of μm is concerned.

When the free end of the movable member 31 to form the slit and/or when the thickness of the member opposite to the side edge is comparable with the thickness of the movable member 31 (FIGS. 3, 4, or so on), by setting relationship of the slit width and thickness within the following range in consideration of tolerance in fabrication, admixing the second textile ink and the first textile ink can be stably restricted. While this is the limited condition, in viewpoint of design, when high viscosity ink (5 cP, 10 cP or so forth) with respect to the second textile ink of the viscosity of less than or equal to 3 cP, admixing of two textile inks can be restricted for long period by satisfying $W/t \leqq 1$.

As set forth above, when the textile inks are functionally separated for the second textile ink and the first textile ink, the movable member 31 will substantially be a partitioning member thereof. Upon moving the movable member 31 in response to generation of bubble, the second textile ink may be slightly admixed with respect to the first textile ink. In consideration of the fact that it is typical to contain 3% to 5% of coloring material to be contained in the first textile ink to form the image, in case of the ink-jet printing, no significant variation of concentration will be caused even when the first textile ink droplet is contained the second textile ink in the extent less than or equal to 20%. Accordingly, as such mixture, with respect to the droplet of the first textile ink, mixture of the second textile ink and the first textile ink to be less than or equal to 20% can be contained in the present invention.

In the implementation of the foregoing embodiment, even by varying viscosity, admixing of the second textile ink is 15% at most. In case of the second textile ink less than or equal to 5 cP, the mixture ratio is in the extent of 10%, while it is variable detecting upon the driving frequency.

Next, positional relationship between the heater 2 and the movable member 31 in the head will be explained with reference to the drawings. The shape, dimension and number of the movable member 31 and the heater 2 are not restricted to those specified. By optimal arrangement of the heater 2 nd the movable member 31, the pressure upon bubbling by the heater 2, can be effectively used as the ejection pressure.

Figure 7:
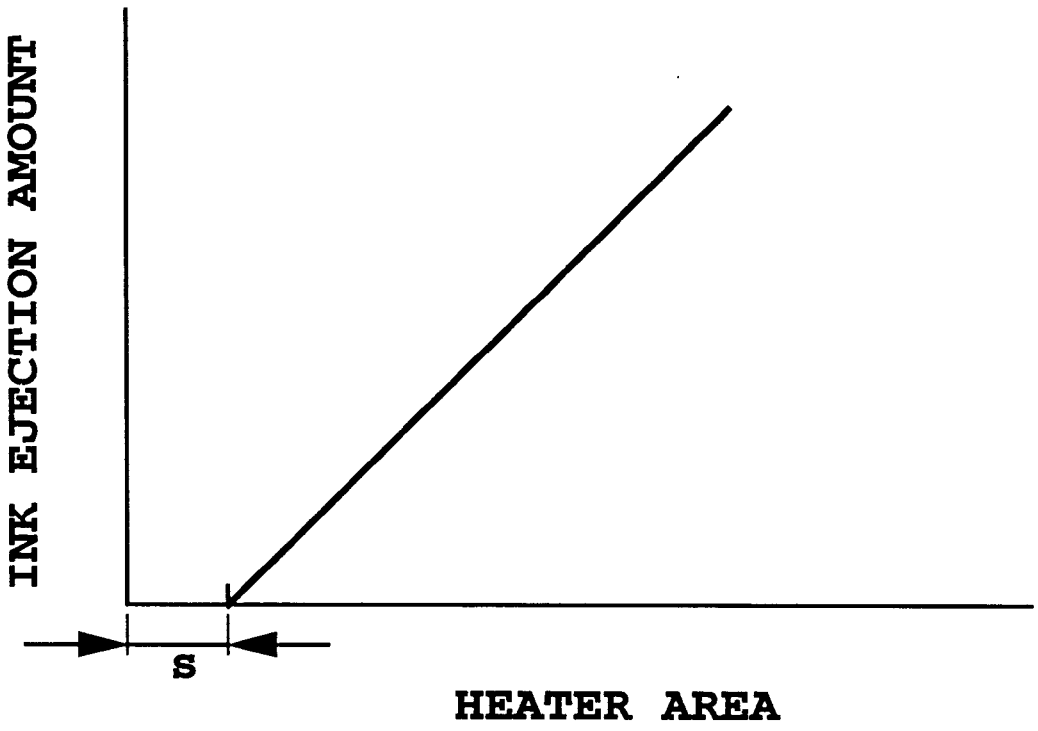
FIG. 7 is a graph illustrating a relationship between an area of a heater and an ink ejection amount.

In the conventional ink-jet printing method, so-called bubble-jet printing method, in which by applying the energy, such as heat, to the ink, abrupt state variation associating with volume variation (generation of bubble) of the ink is caused to eject the ink through the ejection port 18 by the ejection force caused by the state variation to deposit on the printing medium to form the image, there is non-effective bubbling region S which does not contribute for ejection of the ink, is present, as shown in FIG. 7. Also, from torrid on the surface of the heater 2, the non-effective bubbling region S extends around the heater 2. From this result, about 4 μm width around the heater is considered not contributing for bubbling.

Accordingly, in order to effectively use the bubbling pressure, it can be said to be effective to arrange the movable member 31 so that the effective bubbling region inner side distanced from the circumferential edge of the heater in the extent greater than or equal to about 4 μm can be covered with the movable region of the movable member 31. While the effective bubbling region is set to be inside distanced from the circumferential edge of the heater in the extent greater than or equal to about 4 μm, this region is not specific and is variable depending upon kind and fabrication method of the heater.

Figure 8A:
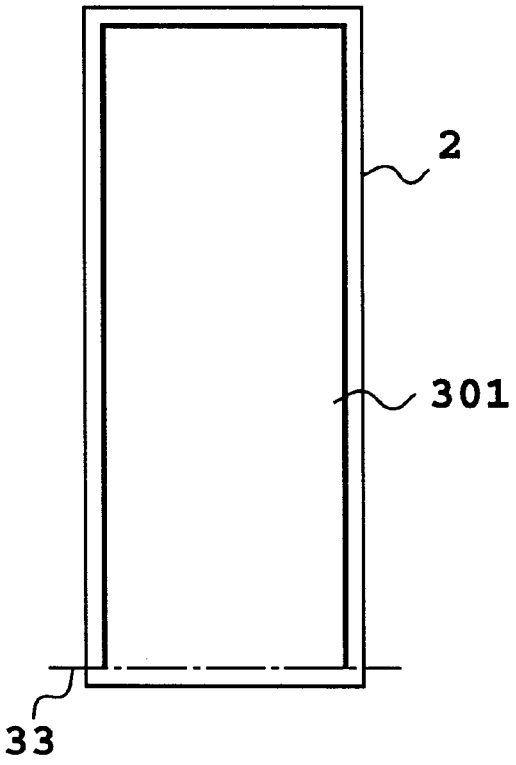
FIGS. 8A and 8B are conceptual illustrations showing relationship of positions of the movable member and the heater.
Figure 8B:
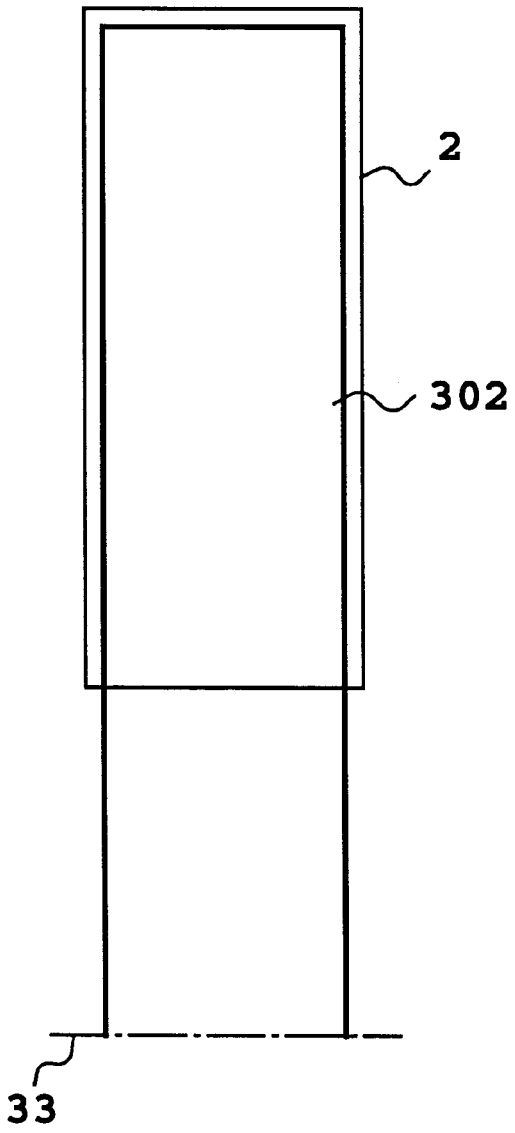

FIG. 8 is diagrammatic illustrations for the case where a movable member 301 (FIG. 8A) and a movable member 302 (FIG. 8B) having mutually different total area of the movable regions are arranged above the heater 2 of 58×150 μm.

The dimension of the movable member 301 is 53×145 μm which is smaller than the area of the heater 2 but is the equivalent dimension and is arranged to cover the effective bubbling region. The dimension of the movable member 302 is 53×220 μm which is greater than the area of the heater 2 (when the width is made equal, the distance between the fulcrum and the movable tip end is longer than that of the heater 2) and covers the effective bubbling region similarly to the movable member 301. In view of both of the durability and ejection efficiency, it has been appreciated that it is superior to provide the movable member to cover the right above the effective bubbling region, and the area of the movable member is greater than the area of the heater 2.

Figure 9:
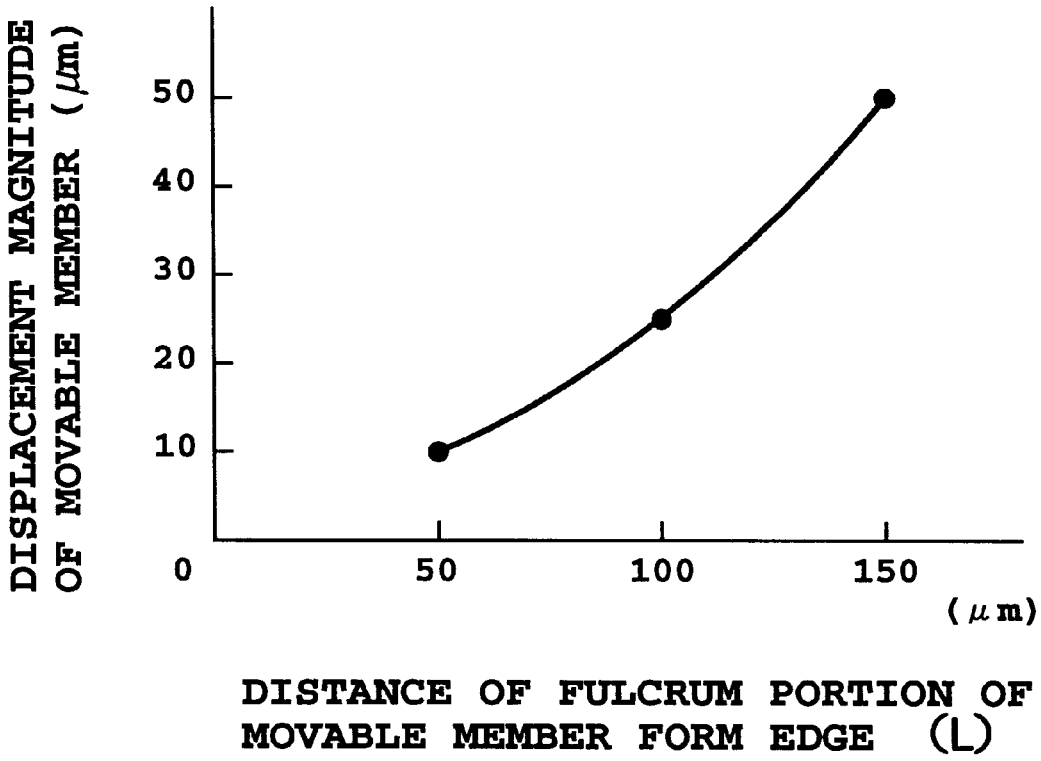
FIG. 9 is a graph illustrating a relationship between a distance between the edge of the heater to a fulcrum and a displacement magnitude of the movable member.
Figure 10:
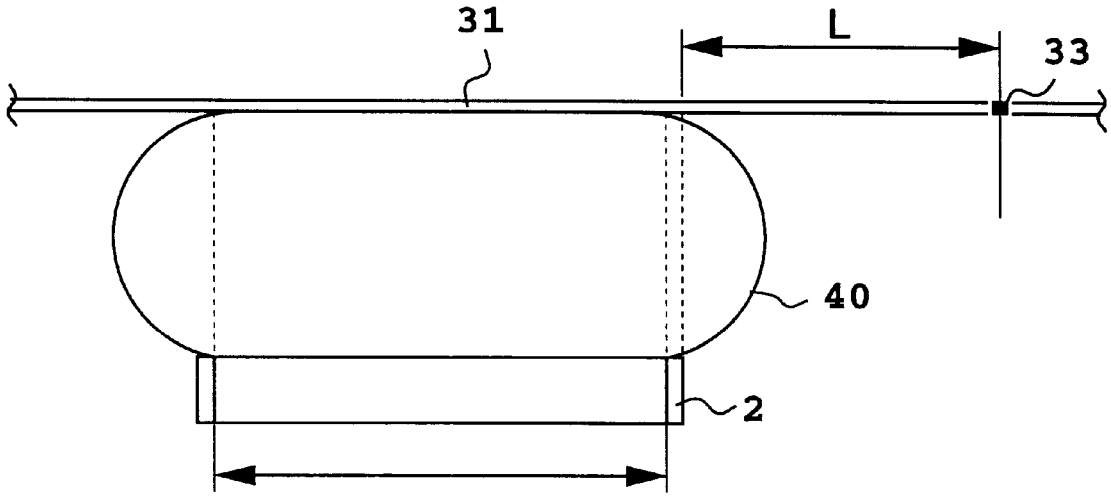
FIG. 10 is a diagrammatic illustration for explaining relationship of position between the heater and the movable member.

FIG. 9 shows a relationship between the distance from the edge of the heater 2 to the fulcrum of the movable member, and the displacement amount of the movable member. In FIG. 10 sectional illustration of the positional relationship between the heater 2 and the movable member 31 as viewed from the side surface direction. The heater 2 of 40×105 μm was employed. It should be appreciated that the magnitude of displacement becomes greater at greater distance L from the edge of the heater 2 to the fulcrum 33 of the movable member 31. Accordingly, depending upon the demanded textile ink ejection amount, liquid passage structure for the first textile ink and configuration of the heater 2, an optimal magnitude of displacement is derived to determine the position of the fulcrum 33 of the movable member 31 based thereon.

When the fulcrum 33 of the movable member 31 is located right above the effective bubbling region of the heater 2, a bubbling stress may be directly exerted on the fulcrum 33 in addition to the stress due to displacement of the movable member 31 to lower durability of the movable member 31. According to the experiments performed by the inventors, when the fulcrum 33 is provided right above the effective bubbling region, damage was caused in the movable member in the extent of $1\times10^6$ pulses. This confirms lowering of the durability. Accordingly, by arranging the fulcrum of the movable member 31 out of the region right above the effective bubbling region, the durability of the movable member 31 can be improved in the extent adapted to the practical use even when the configuration and material of the movable member does not achieve high durability. Even when the fulcrum is present right above the effective bubbling region, the movable member may be used satisfactorily by selecting the configuration and material appropriately. In such construction, the liquid ejection head achieving high ejection efficiency and superior durability can be obtained.

<Element Substrate>

Hereinafter, the construction of the element substrate 1, on which the heater 2 is provided for applying heat to the textile ink will be explained.

Figure 11A:
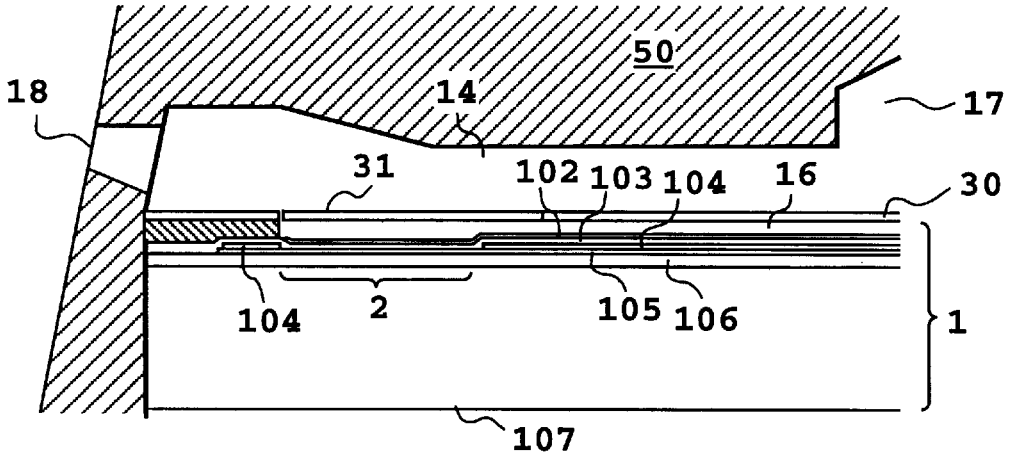
FIGS. 11A and 11B are longitudinal sections showing another embodiment of the liquid ejection head which can implement the present invention.
Figure 11B:
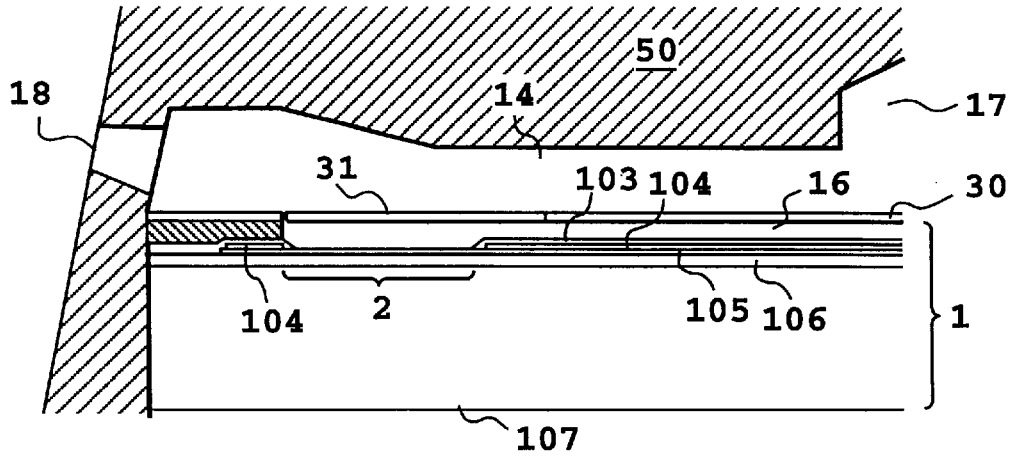

FIG. 11 is longitudinal sections of the liquid ejection head according to the present invention, wherein FIG. 11A shows the head with a protective layer set out later, and FIG. 11B is the head having no protective layer.

On the element substrate 1, the second liquid passage 16, the separation wall 30, the first liquid passage 14 and the grooved member 50 formed with the groove for defining the first liquid passage 14 are arranged.

In the element substrate 1, silicon oxide layer or silicon nitride layer 106 for insulation and heat accumulation is deposited on a substrate 107 of silicon or the like. On the silicon oxide layer or silicon nitride layer 106, an electric resistor layer 105 (0.01 to 0.2 μm thick), such as hafnium diboride ($HfB_2$), tantalum nitride (TaN), tantalum aluminum (TaAl) or the like, and a wiring electrodes 104 (0.2 to 1.0 μm thick) of aluminum or the like are patterned as shown in FIG. 2. Applying a voltage from the two wiring electrodes 104 to the resistor layer 105 to flow a current to generate a heat. On the resistor layer 105 between the wiring electrodes 104, a protective layer 103 of 0.1 to 2.0 μm thick is formed with silicon oxide or silicon nitride. Furthermore, over the protective layer, an anti-cavitation layer 102 (0.1 to 0.6 μm thick) of tantalum or the like is deposited for protecting the resistor later 105 from the textile ink.

Particularly, the pressure to be generated upon extinction of bubble or impulsive wave is quite strong to significantly lower durability of stiff and brittle oxide layer. Therefore, the metal, such as tantalum (Ta) or the like is used as the anti-cavitation layer 102.

By combining the liquid, the liquid passage construction, resistor material, it can be establish a structure which does not require the protective layer 103, as shown in FIG. 11B. As a material for the resistor layer which does not require the protective layer, iridium-tantalum-aluminum alloy or the like may be employed.

As the construction of the heater 2 in the foregoing respective embodiment, it may be only the resistor layer (heating portion), or in the alternative, the protective layer may be formed for protecting the resistor layer.

In the present embodiment, the heating portion constructed with the resistor layer which generates a heat in response to the electric signal, is employed as the heater 2. However, the heater is not specified to the shown construction but can be of any construction as long as sufficient bubble can be generated in the second textile ink so as to eject the first textile ink. For example, an optical-thermal transducer heated by receiving a light, such as a laser beam or the like or a heating body to be heated in response to a high frequency, may be employed as the heater 2.

On the foregoing element substrate 1, in addition to the resistor layer 105 forming the heating portion and the electrothermal transducer constructed with the wiring electrodes 104 for supplying the electric signal to the resistor layer 105, functional device, such as transistors, diodes, latch, shift register and so on are integrally formed through a semiconductor fabrication process.

Figure 12:
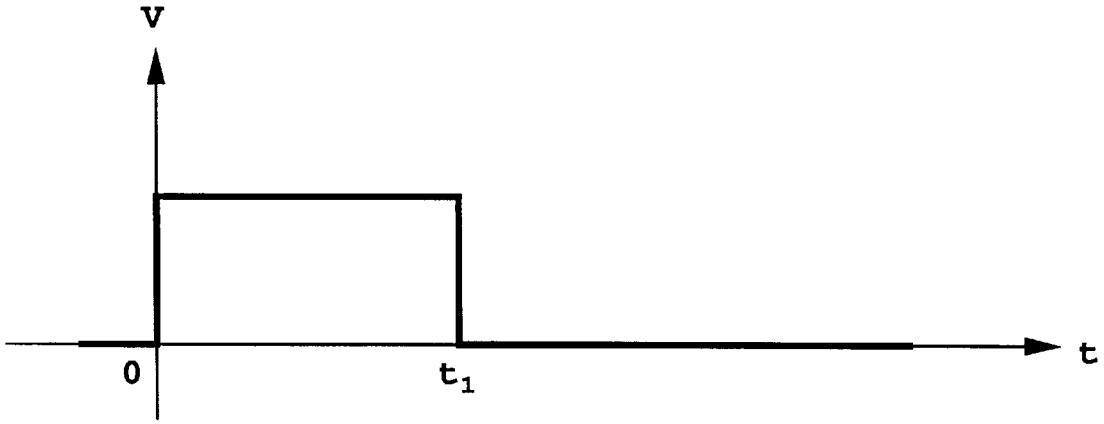
FIG. 12 is a diagrammatic view showing shape of a driving pulse.

In order to drive the heating portion of the electrothermal transducer provided on the element substrate 1 for ejecting the textile ink, a rectangular pulse as shown in FIG. 12 is applied to the resistor layer 105 via the wiring electrodes 104 to abruptly heat the resistor layer 105 between the wiring electrodes. In the head of respective of the foregoing head, a voltage 24V, a pulse width 7 μsec, a current 150 mA are applied as the electric signal at a frequency of 6 kHz to drive the heater 2. By the foregoing operation, the textile ink is ejection from the ejection ports 18. However, the condition of the driving signal is not limited to the above, but can be of any driving signal which can appropriately cause bubbling of the second textile ink.

<Head Structure with Dual Liquid Passage Construction>

Hereinafter, an embodiment of the liquid ejection head which can satisfactorily introduce mutually different textile ink in the first and second common liquid chamber to contribute for reduction of number of parts and thus to enable lowering of the cost.

Figure 13:
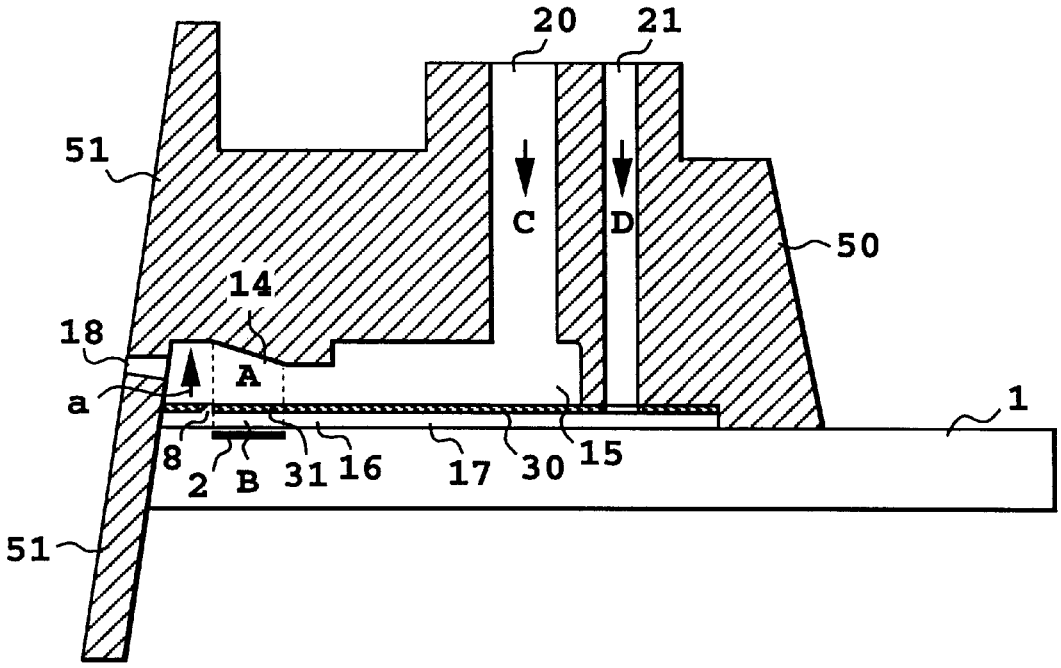
FIG. 13 is a section for explaining a supply passage of the liquid ejection head which can implement the present invention.

FIG. 13 is a diagrammatic illustration showing a structure of the liquid ejection head. Like elements to the former embodiments will be identified by the same reference numeral and detailed description therefor keep the disclosure simple enough to facilitate clear understanding of the invention.

In the present embodiment, the grooved member 50 is generally comprises an orifice plate 51 having the ejection ports 18, a plurality of grooves forming a plurality of first liquid flow passages 14, and a cavity forming the first common liquid chamber 15 for supplying the first textile ink to each of the first liquid passage 14.

On the lower portion of the grooved member 50, the separation wall 30 is coupled to define a plurality of the first liquid passage 14 can be formed. Such grooved member 50 has a first textile ink supply passage 20 reaching into the first common liquid chamber 15 from the above. Also, the grooved member 50 has the second textile ink supply passage 21 extending through the separation wall 30 to reach the second common liquid chamber 17 from the above.

The first textile ink is supplied to the first common textile ink chamber 15 via the first liquid supply passage 20, and then supplied to the first liquid passage 14, as shown by arrow C in FIG. 13. The second textile ink is supplied to the second common textile ink chamber 17 via the second liquid supply passage 21, and then supplied to the second liquid passage 16 as shown by arrow D in FIG. 13.

In the present embodiment, the second textile ink supply passage 21 is arranged in parallel to the first textile ink supply passage 20. However, the layout of the first and second textile ink supply passages 20 and 21 is not specified to the shown arrangement, but any arrangement may be employed as long as the second textile ink supply passage communication with the second common liquid chamber 17 through the separation wall 30 arranged at the outer side of the first common liquid chamber 15.

The thickness (diameter) of the second textile ink supply passage 21 is determined in view of the supply amount of the second textile ink therethrough. The cross section of the second textile ink supply passage 21 is not necessarily circular but can be of any appropriate configuration, such as rectangular or the like.

The second common liquid chamber 17 may be defined by separating the grooved member 50 with the separation wall 30. As a method of forming, as shown by exploded perspective view shown in FIG. 14, it can be formed by forming the common liquid chamber frame 71 and the second liquid passage wall 72 by a dry film, on the element substrate 1, and an assembly of the grooved member 50 with the separation wall 30 coupled to the former are bonded to the element substrate 1 to form the second common liquid chamber 17 and the second liquid passage 16.

In the present embodiment, on the support body 70 formed with a metal, such as aluminum or the like, the element substrate 1 which is provided with a plurality of electrothermal transducer element as the heater for generating heat for generating the bubble by film boiling in the bubbling liquid.

On the element substrate 1, a plurality of grooves forming the liquid passages 16 defined by the second liquid passage wall 72, a cavity forming the second common liquid chamber (common bubbling liquid chamber) 17 for supplying bubbling liquid into each bubbling liquid passage, and the above mentioned separation wall 30 provided with the movable member 31 are arranged.

The reference numeral 50 denoted the grooved member. The grooved member includes the groove forming the first liquid passage by coupling to separation wall 30, the cavity for forming the first common liquid chamber 15 for supplying the first textile ink to the each first liquid passage 14, the first textile ink supply passage 20 for supplying the first textile ink to the first common liquid chamber 15, and the second textile ink supply passage 21 for supplying the second textile ink to the second common liquid chamber 17. The second textile ink supply passage 21 is connected to a communication passage which is, in turn, communicated with the second common liquid passage 17 through the separation wall 30 located outside of the first common liquid chamber 17. By this communication passage, the second textile ink can be supplied to the second common liquid chamber 17 without causing admixing with the first textile ink.

The positional relationship between the element substrate 1, the separation wall 30 and the grooved upper plate 50 is that the movable member 31 is arranged opposing to the to the heater of the element substrate 1. Corresponding to the movable member 31, the first liquid passage 14 is arranged. In the present embodiment, there is illustrated the embodiment, in which a second supply passage is arranged in the grooved member. However, it is possible to provide a plurality of the second liquid supply passage depending upon supply amount of the textile ink. Furthermore, the cross sectional areas of the first textile ink supply passage 20 and the second textile ink supply passage 21 may be determined depending upon supply amount of the textile inks liquid.

Thus, by optimization of the cross section area, the parts forming the grooved member 50 and so on can be made more compact.

With the present embodiment set forth above, the second supply passage 21 supplying the second textile ink to the second liquid passage 16 and the first supply passage 20 supplying the first textile ink to the first liquid passage 14 are formed on the common grooved member serving as grooved upper plate 50. Thus, number of parts becomes smaller to permit shortening of the process to result is lowering of the cost.

The supply of the second textile ink to the second common liquid chamber 17 communicated with the second liquid passage 16 is performed by the second liquid passage 16 in a direction extending through the separation wall 30 separating the first and second textile inks. This requires bonding process of the separation wall 30, the grooved member 50 and the substrate 1 formed with the heaters can be done at one time to improve easiness of fabrication and improve bonding accuracy to results in good ejection.

Since the second textile ink is supplied to the second common liquid chamber 17 through the separation wall 30, supply of the second textile ink to the second liquid passage 16 can be assured to certainly reserve sufficient amount to permit stable ejection.

<First Textile Ink and Second Textile Ink>

In the following table 1, dyeing ability between typical fibers forming clothes and dyes will be exemplified. In the table 1, 0 represents high dyeing ability, Δ represents that dyeing is possible. For example, in case of polyester, use of disperse dye is particularly desirable, and in case of acrylate, use of cation dye is particularly desirable.

TABLE 1

| | Water Soluble Dye | | | | | | | Non | | | |
|---|---|---|---|---|---|---|---|---|---|---|---|
| | | | Metalic | Cation | Acid | | | Water-Soluble Dye (1) | | Non Water-Soluble Dye (2) | |
| Fiber | Direct | Acid | Complex Salt | (Base) | Mordant | Naphthol | Reactive | Vat | Sulfide | Disperse | Pigment |
| Cotton | Δ | | | | | ○ | ○ | ○ | ○ | | ○ |
| Hemp | | | | | | | | | | | |
| Rayon | | | | | | | | | | | |
| Wool silk | Δ | ○ | ○ | Δ | ○ | | Δ | | | | Δ |
| Acetate | | Δ | | | | Δ | Δ | Δ | | ○ | Δ |
| Nylon | Δ | ○ | ○ | Δ | ○ | Δ | | | | Δ | Δ |
| Polyester | | | | | | | | | | ○ | Δ |
| Acrylate | | Δ | Δ | ○ | | | | | | Δ | Δ |
| Vinylon | Δ | | | Δ | | ○ | | Δ | Δ | Δ | Δ |

Here, vat dye or sulfide dye of non water-soluble dye (1) in the foregoing table can be converted into water soluble by performing reduction process, the dispersion dye and pigment of the non water-base dye (2), can be dispersed in water by depositing dispersion agent therearound. Amongst, non water-soluble dye (2) has lower thermal stability in comparison with other dye.

From the relationship set forth above, when textile printing is performed for blended fabric cloth, such as cotton and polyester, or nylon and polyester, it is desirable that the disperse dye, having low thermal stability, mixed with the first textile ink is used, and the water-soluble dye mixed with the second textile ink is used.

In more detail, when the ink-jet textile printing method for the blended cloth of the cotton and polyester, the textile ink for polyester, which is thermally unstable, is supplied to the first liquid passage which is not heated directly. The textile printing ink for cotton containing the water-soluble dye which is tough against heat, is supplied to the second liquid passage. Thereby, printed image can be formed by stable ejection and printing even with the bubble-jet type head.

Originally, the polyester fiber has hydrophobic property as polymer and thus is difficult to be dyed by the water-soluble dye, such as direct dye, acid dye or the like which is soluble in water, and thus cannot be obtained clear textile printed image unless the dye, such as disperse dye, of the type to penetrate into the polymer by post-process, such as heating (steaming).

It is naturally difficult to keep stability of the disperse dye penetrating into the fiber, as heated in the extent causing bubbling of water as the dispersion medium, by heating (steaming). Thus, the foregoing construction becomes necessary.

In contrast to this, the fiber having high hygroscopic property, such as cotton, silk and the like, has large amount of hydrophilic radical. Therefore, it can be dyed to form the satisfactorily clear image by the water-soluble direct dye or acid dye. Since the water-soluble dye is performed the fixing process of dye by chemical process before and after dyeing, the water-soluble dye is thermally stable in comparison with the disperse dye.

It is typical to use the disperse dye dispersed or dissolved with taking water as a medium similarly to the water-soluble dye, and can be mixed. However, when the mixed ink is used, it is not desirable since the disperse dye is directly contact with the heater.

With the construction set forth above, as ejected from the ejection port, the water-soluble dye and the disperse dye are ejected in mixed condition to adhere on the blended cloth as a printing object. Without employing two kinds of ink-jet head, two kinds of dyes for polyester and cotton can be printed at one event.

In such construction, it is desirable to use dyes so that the color for polyester and cotton become the same. When printing is performed by different colors, consideration for design and image processing becomes necessary.

Blending ratio of the blended fibers forming the objective cloth fiber printing medium is exemplified in terms of cotton and polyester as the following two typical ratios.

| Cloth | Example 1 | Example 2 |
|---|---|---|
| Cotton | 50% | 65% |
| Polyester | 50% | 35% |

It is required to vary mixture rate of the first textile ink and the second textile ink for adapting to respective blending ratios.

For ejecting the first textile ink and the second textile ink at a predetermined mixture ratio, means for structurally adjusting the mixture ratio, such as by adjusting opening areas of the narrowed portion 19 or to adjust magnitude of displacement of the movable member by selecting material and shape of the movable member, means for electrically adjusting the mixture ratio, such as by varying the pulse width or the driving frequency of the driving signal to be applied to the heater, and so on. In the later system controlling the signal to be applied, is advantageous since it does not require to exchange of the head and can vary the mixture ratio of the ejected inks only by the driving condition.

Specifically, when a proportion of the cotton in the blended cloth of the cotton and polyester is high, namely when the proportion of the second textile ink in the mixture to be ejected is to be increased, such increased proportion of the second textile ink can be realized by setting the pulse width of the driving signal longer and the driving frequency higher.

Particular example of control for controlling the mixture ratio of the mixture inks to the ejected depending upon the blending ratio of the blended fibers as the cloth will be described with reference to the drawings.

Figure 25:
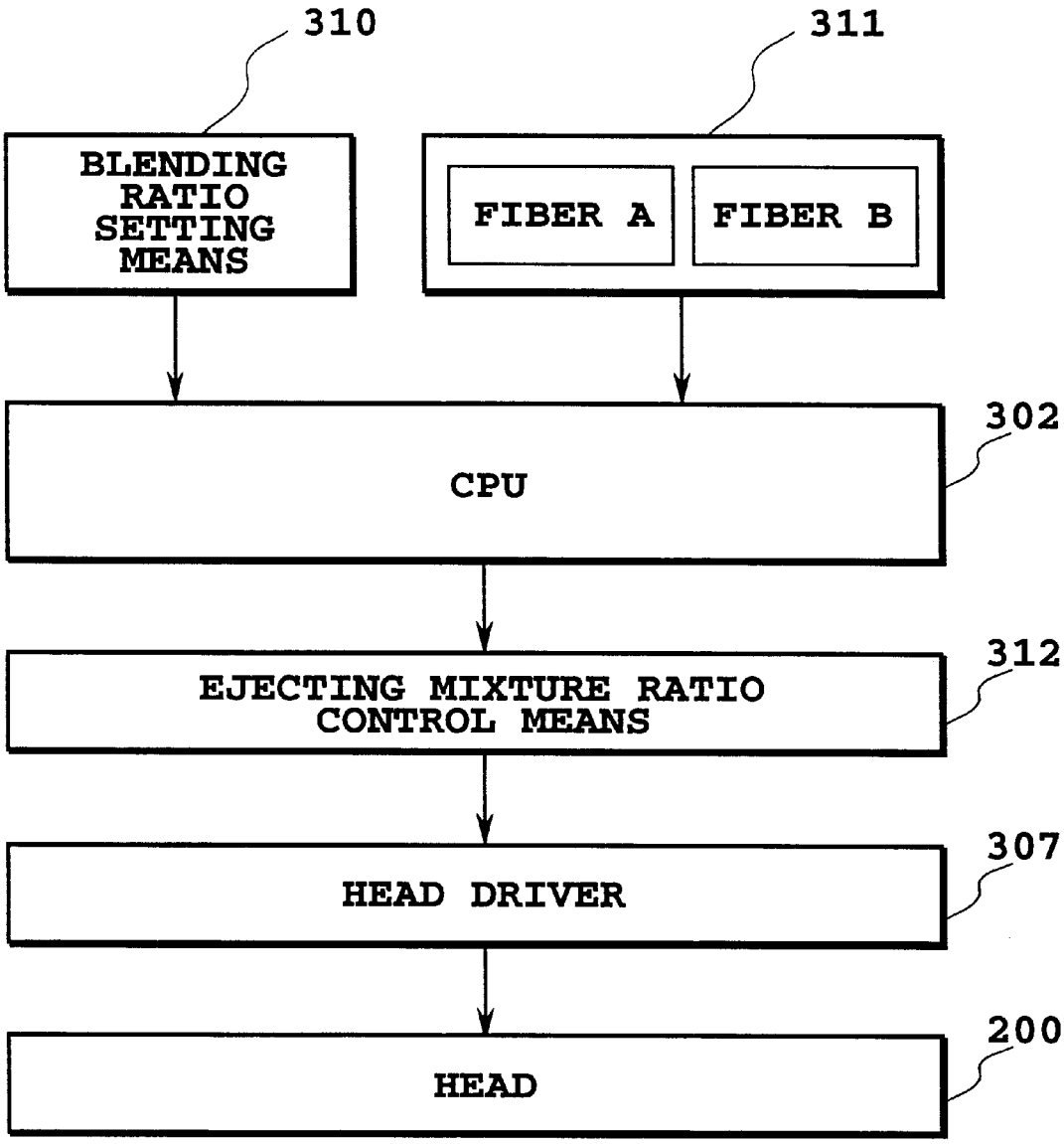
FIG. 25 is a block diagram showing major components of the printing apparatus realizing the mixture ratio control for the mixture inks to be ejected, according to the present invention.

FIG. 25 is a block diagram showing major components of the printing apparatus realizing the mixture ratio control for the mixture inks to be ejected, according to the present invention. The reference numeral 302 denotes CPU which controls the printing apparatus on the basis of a not shown control program and whereby controls printing operation. The head 200 is driven by a head driver 307 to form the image. In FIG. 25, the reference numeral 311 denotes a material setting means for setting kinds of blended fibers forming the cloth. When the blended fibers forming the cloth is consisted of two kinds of materials, the material setting means 311 permits setting for two materials, i.e. fiber A and fiber B. The reference numeral 310 denotes a blending ratio setting means for setting the composition ratio of the blended fibers forming the cloth. The blending ratio setting means 310 sets the proportions of respective materials set by the material setting means 311. The blending condition set by the material setting means 311 and the blending ratio setting means 310 is processed by CPU 302. Then, a driving condition for ejecting the mixture inks, in which the first textile ink and the second textile ink are mixed adapting to the blending ratio of the blended cloth, is set by ejecting mixture ratio control means 312. A head driver 307 drives the head 200 on the basis of the driving condition. With such construction, the ink corresponding to a plurality of materials forming the blended cloth can be ejected at an appropriate ratio depending upon the blending ratio of the blended cloth.

Next, as one example of control of the mixture ratio of the mixture inks to be ejected, a process for setting the driving condition of the head 200 will be explained with reference to the flowchart shown in FIG. 26. When a process for setting the driving condition of the head 200 is initiated at step S101, setting of a condition relating to the blended cloth is performed at step S102. The process to be performed at step S102 includes process for inputting signals representative of the blending condition set by the material setting means 311 and the blending ratio setting means 310 shown in FIG. 25, process for prompting to the user to designate the blending condition to for setting of the condition. At the subsequent step S103, setting of driving condition adapted to the blending condition set at step S102, is performed. Then, the process goes end (step S104). As the process to be performed at step S103, there is a process to read out the driving condition corresponding to the blended cloth set at step S102 from a table of the driving condition corresponding to the blending condition, which table is preliminarily stored in storage means, such as ROM or the like, to store the read out driving condition to storage means, such as RAM or the like.

Figure 26:
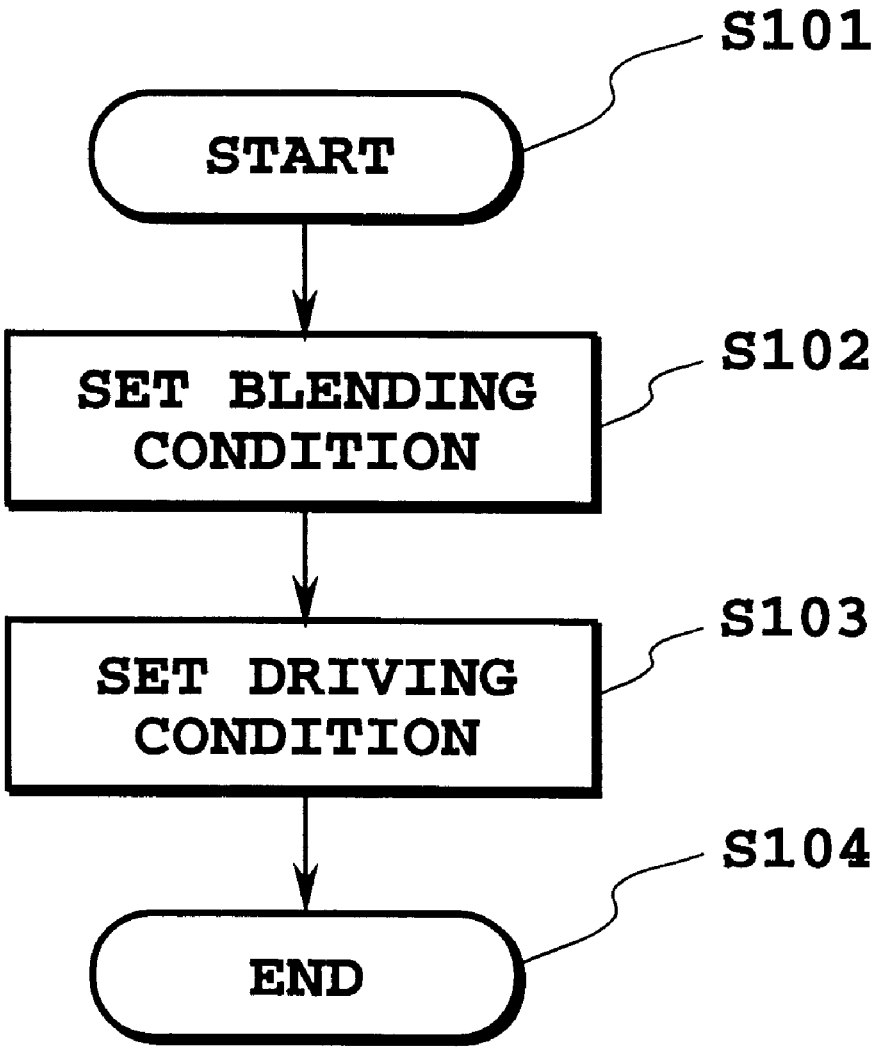
FIG. 26 is a flowchart illustrating a process for performing of setting of the driving condition.

In the process illustrated in the flowchart of FIG. 26, a process for performing setting of the driving condition in advance of printing operation of the image after setting of the condition of the blended fibers forming the cloth. However, the process for setting the driving condition adapting to the blending ratio of the blended cloth is not limited to the shown process. For example, the process may be established to set the driving condition by the ejecting mixture ratio control means on the basis of an image data output from CPU 302 as shown in FIG. 25, and to drive the head 200 on the basis of the set driving condition.

Figure 27:
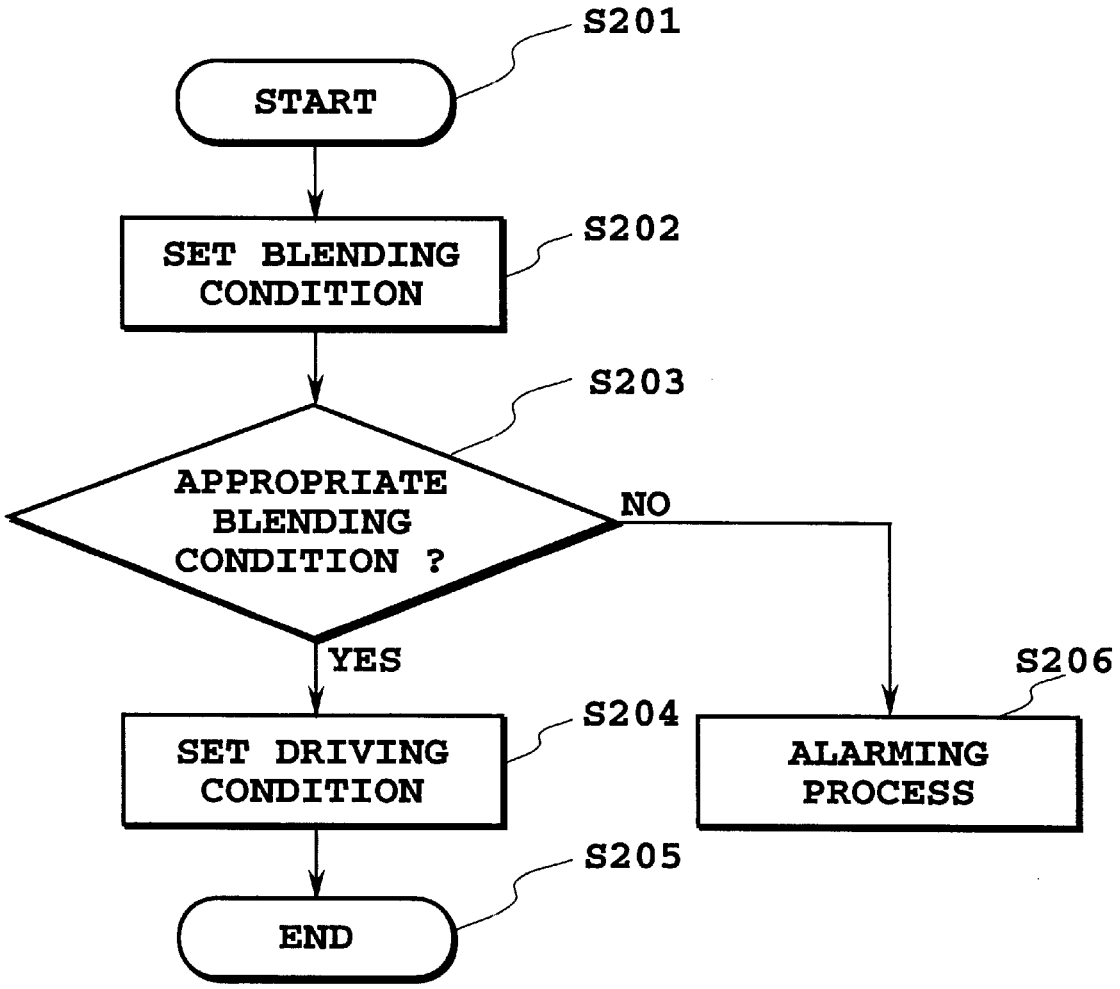
FIG. 27 is alternative flowchart illustrating a process for performing of setting of the driving condition.

FIG. 27 is a modification of the flowchart showing in FIG. 26, which is differentiated from the flowchart of FIG. 26 in the process at steps S203 and S206. In the following disclosure, the process steps the same as those in the process of FIG. 26 will be neglected.

After setting the condition relating to the blended cloth at step S202, judgement whether the blending condition is appropriate or not, is made at subsequent step S203. Here, judgment for compatibility of the kinds of textile inks currently used in the printing apparatus and the kinds of the textile inks adapted to the material forming the blended yarn fabric or judgement whether the set blending ratio of the blended cloth is appropriate or not, is made, If the appropriateness is judged at step S203, setting of the driving condition is performed at step S104. A process at step S104 is the same as that in step S103 of FIG. 26, and thus the detained description is neglected. When inappropriateness is judged at step S203, the process is advanced to step S206 to perform alarming process to notice inappropriateness of the set condition and to prompt resetting of the blending condition to the user.

As explained with reference to FIGS. 25, 26 and 27, by preliminarily designating the fibers A and B, information of the first textile ink and the second textile ink corresponding to the fibers A and B, or the blending ratio of the blended cloth, printing is performed by driving the head 200 on the basis of the sequentially supplied image signal by setting the optimal driving condition of the head 200 by processing the preliminarily designated information by CPU 302.

With such construction, without requiring complicate apparatus, the textile inks corresponding to a plurality of materials forming the blended cloth can be mixed at an appropriate ratio corresponding to the blending ratio of the fibers in the blended cloth and ejected for stably printing the high quality of image.

In the embodiment where both the first textile ink and the second textile ink are ejected according to the present invention, since the second textile ink of the elevated temperature can be ejected, elevation of the temperature of the second textile ink can be restricted to make the bubbling condition stable to enhance stability of ejection.

<Fabrication of Liquid Ejection Head>

In case of the liquid ejection head shown in FIG. 2, the head is formed by patterning the base 34 for providing the movable members 31 on the element substrate 1 with a dry film or the like, bonding or welding the movable members 31 on the base 34, and subsequently, fitting the grooved member having a plurality of grooves forming respective liquid flow passages 10, the ejecting ports 18, and cavities forming the common liquid chamber 15, on the element substrate 1 with aligning respective grooves and movable members 31.

Figure 14:
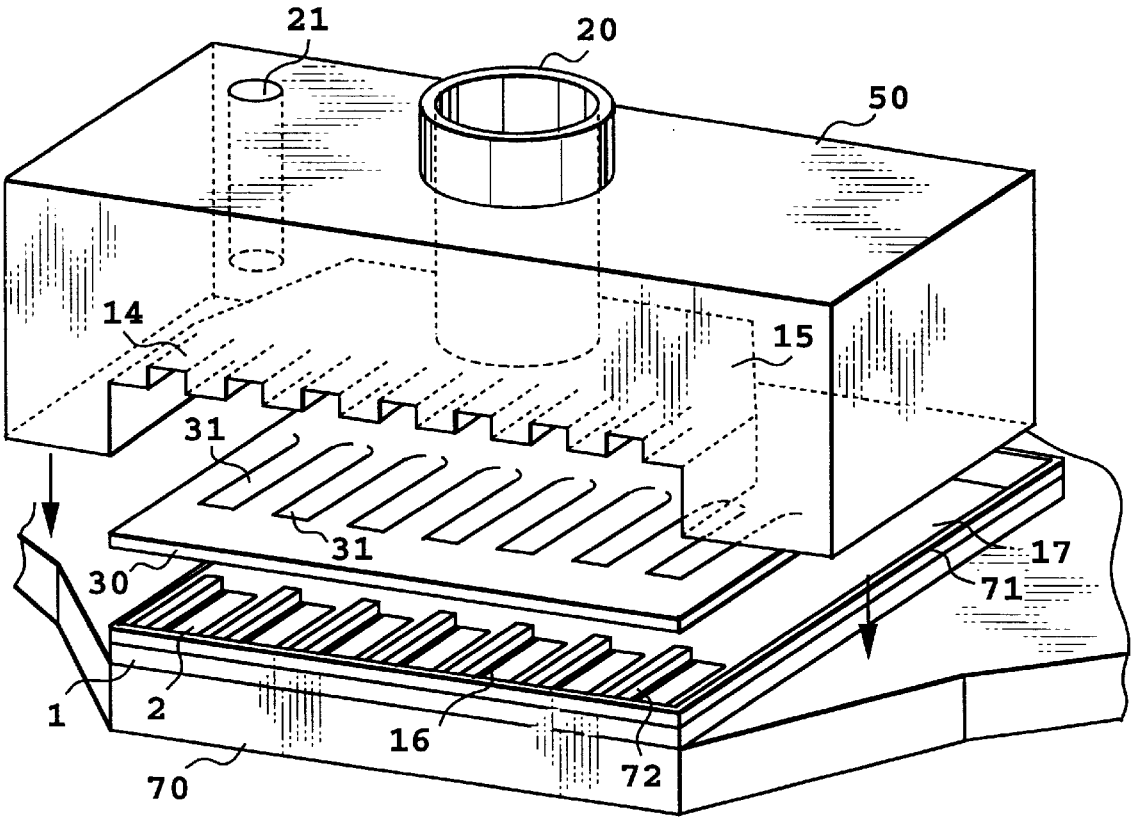
FIG. 14 is an exploded perspective view of the head which can implement the present invention.

Next, fabrication process of the liquid ejection head having dual liquid passage structure as shown in FIGS. 1 and 14 will be described.

In general, the wall for the second liquid passage 16 is formed on the element substrate 1. The separation wall 30 is mounted thereon. The grooved member 50 having the grooves for defining the first liquid passages 14 is mounted thereon. In the alternative, after forming the wall of the second liquid passage 16, the grooved member 50 mounted thereon the separation wall 30, is mated to fabricate the head.

The fabrication process of the second liquid flow passage will be explained in greater detail.

FIGS. 15A to 15E are general sectional views for explaining the first embodiment of the liquid ejection head fabrication process according to the present invention.

Figure 15A:
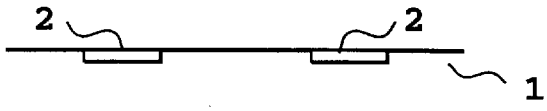
FIGS. 15A to 15E are sections of process steps for explaining a fabrication process of the liquid ejection head which can implement the present invention.

In the present embodiment, as shown in FIG. 15A, on the element substrate (silicon wafer) 1, electrothermal transducer element having the heater 2 was formed with hafnium diboride or tantalum nitride and so on employing a fabrication apparatus similar to that employed in a semiconductor fabrication process. Thereafter, for the purpose of improvement adhesion ability with a photosensitive resin, the surface of the element substrate 1 was washed. For further higher adhesion ability can be attained by performing property modification of the surface by ultraviolet-ozone treatment for the surface of the element substrate, and by spin coating a solution, in which a silane coupling agent (Nihon Unica Co.: Al89), for example, is diluted by ethyl alcohol into 1 Wt %, on the surface of modified property.

Figure 15B:
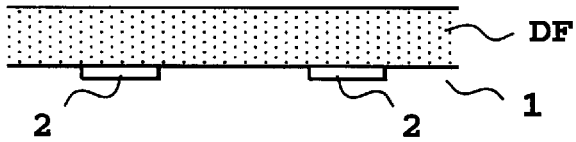

Next, on the surface of the substrate 1, which was washed for improving adhesion ability, an ultraviolet sensitive resin film (TOKYO OHKA KOGYO CO., LTD.: dry film Ordyl SY-318) DF was laminated as shown in FIG. 15B.

Figure 15C:
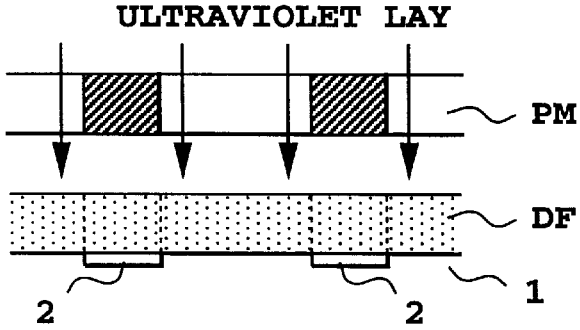

Next, as shown in FIG. 15C, arranging a photo-mask PM on the dry film DF, a ultraviolet ray was irradiated for the portion of the dry film DF to be maintained at the wall for the second liquid flow passage through the photo-mask PM. This exposure step was performed employing Canon INC.: MPA-600 with an exposure amount about 600 mJ/cm$^2$.

Figure 15D:
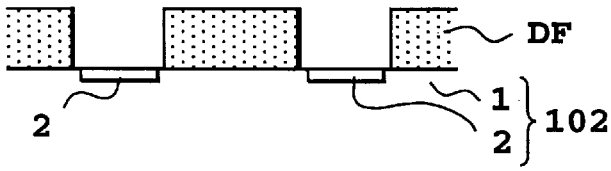

Next, as shown in FIG. 15D, the dry film DF was developed by a developing solution (TOKYO OHKA KOGYO CO., LTD.: BMRC-3) consisted of a mixture of xylene, butyl cellosolve acetate for dissolving the non-exposed portion with leaving the portion hardened by exposure to form the wall portion of the second liquid passage 16. Also, a slag left on the surface of the element substrate 1 was removed by treatment for about 90 seconds by a oxygen plasma ashing apparatus (Alkantec Co.: MA-800). Subsequently, further irradiation of ultraviolet way at 100 mJ/cm$^2$ was performed under 150° C. for 2 hours to completely harden the exposed portion.

Through the foregoing process, for a plurality of heater board (element substrate 1) divided and fabrication from the silicon substrate, the second liquid flow passage can be formed uniformly with high precision. The silicon substrate is cut into each individual heater board 1 by means of a dicing machine (Tokyo Seimitsu Co.: AWD-4000) mounted thereon a 0.05 mm thick diamond blade. The divided heater board 1 is fixed on an aluminum base plate 70 by a bond (Toray Industries, Inc.: SE4400) (see FIG. 18). Then, the heater board 1 is connected with a printed circuit board 71 preliminarily fitted on the aluminum base plate 70, via a aluminum wire of 0.05 mm diameter.

Figure 15E:
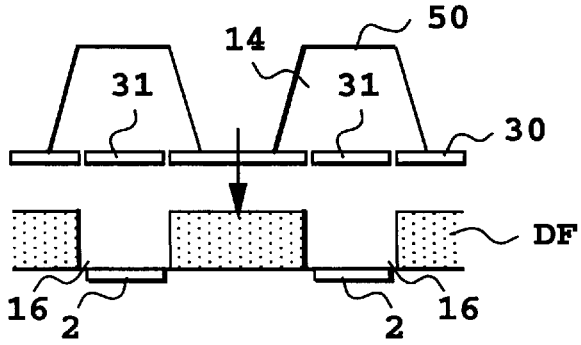

On the heater board 1 thus obtained, as shown FIG. 15E, a sub-assembly of the grooved member 50 and the separation wall 30 is positioned and fixed in the manner set forth above. Namely, with positioning the grooved member 50 having the separation wall 30 and the heater board 1 relative to each other, the assembly is fixed by engagement of a set spring 78. Then, ink and second textile ink supply member 80 is mated and fixed on the aluminum base plate 70. Thereafter, gap defined between the aluminum wires, gaps defined between the grooved member 50, the heater board 1 and the ink and second textile ink supply member 80 were sealed by a silicon sealant (Toshiba Silicon CO. Ltd.: TSE399).

By forming the second liquid passage through the process set forth above, high precision liquid passage can be obtained without any position error relative to the heater of each heater board 1. Particularly, by preliminarily mating the grooved member 50 and the separated wall 30 in the preceding step, the high precision of position of the first liquid passages 14 and the movable member 31 can be achieved.

With these high precision fabrication technology, ejection can be stabilized to improve printing quality. Furthermore, since all elements can be formed on the wafer, the head can be mass-produced at low cost.

While the ultraviolet curing type dry film is employed for forming the second liquid passage in the present embodiment, it is also possible to employ a resin having an absorption band in an ultraviolet band, particularly in a range close to 248 nm, to cure the same after lamination and then to remove resin at the portion to be the second liquid passage by an excimer laser.

Figure 16A:
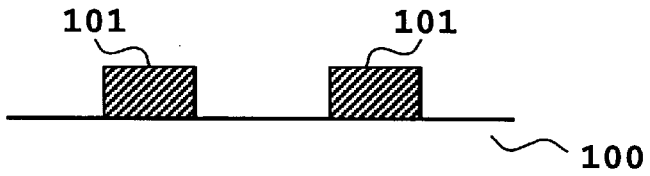
FIGS. 16A to 16D are sections of process steps for explaining a fabrication process of the liquid ejection head which can implement the present invention.

FIGS. 16A to 16D are general sections for explaining the second embodiment of the liquid ejection head according to the present invention, In the present embodiment, as shown in FIG. 16A, on a SUS substrate 100, a resist 101 of a thickness of 15 $\mu$m is patterned in the shape of the second liquid flow passage.

Figure 16B:
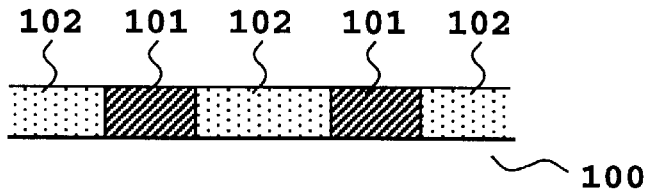

Next, as shown in FIG. 16B, electroplating is performed for the SUS substrate 100 to form a nickel layer 102 of the thickness of 15 $\mu$m thereon. As a plating liquid, a liquid added a stress reduction agent (World Metal Co.: Zero All), boric acid, a pit preventing agent (World Metal Co.: NP-ASP) and nickel chloride to nickel sulfamate may be used. As a manner of application of electric field upon electrode position, an electrode is connected at an anode side and already patterned SUS substrate 100 is connected at cathode side, an electric current having current density of 5 A/cm$^2$ is applied at a temperature of plating liquid of 50° C.

Figure 16C:
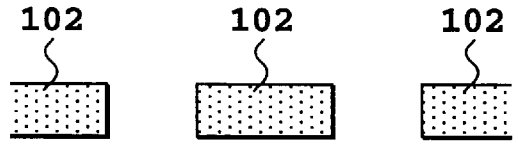

Next, as shown in FIG. 16C, ultrasonic vibration is applied to the SUS substrate 100 completed the plating process as set forth above to peel off a part of the nickel layer 102 from the SUS substrate 100 to obtain the designed configuration of second liquid passage.

Figure 16D:
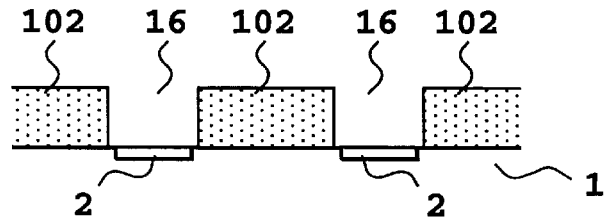

The heater board arranged the electrothermal transducer is formed on the silicon wafer using the fabrication device similar to that for the semiconductor fabrication apparatus. This wafer is cut into each individual heater board by the dicing machine as mentioned embodiment. The heater board 1 is then fitted on the aluminum base plate 70, on which the printing circuit board is preliminarily mounted. Then, electric wiring is formed by connecting the printed circuit board and the aluminum wire (not shown). On the heater board 1 in this condition, as shown in FIG. 16D, the second liquid passage obtained in the former process is positioned and fixed. At this time, "fixing" is merely required to prevent position error upon fitting of the upper plate for engaging and tightly fitting the upper plate fixed therewith the separation wall by the set spring similarly to the first embodiment.

In the present embodiment, for fixing, an ultraviolet curing type bond (Grace Japan Co.: Amicon UV-300) is applied. Then, employing an ultraviolet ray irradiation device, ultraviolet ray is irradiated in exposure amount of 100 mJ/cm$^2$ for about 3 seconds for fixing.

With the present embodiment of the fabrication process set forth above, in addition to capability of obtaining high precision second liquid passage with no position error relative to the heater 2, since the liquid passage is formed by nickel, the liquid ejection head achieving high reliability with high resistance against alkaline can be provided.

FIGS. 17A to 17D are generation sections for explaining the third embodiment of the liquid ejection head fabrication process according to the present invention.

Figure 17A:
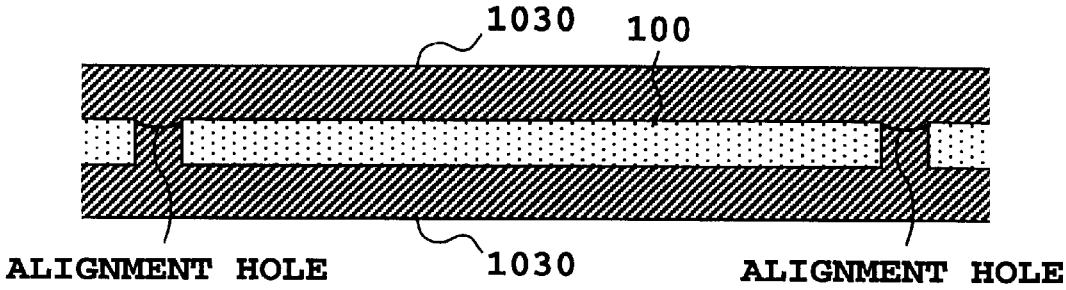
FIGS. 17A to 17D are sections of process steps for explaining a fabrication process of the liquid ejection head which can implement the present invention.

In the present embodiment, as shown in FIG. 17A, on both surface of the SUS substrate 100 of 15 $\mu$m thick having alignment holes or marking 100*a*, a resist 1030 is applied. Here, as the resist, PWERR-AR900 available from TOKYO OHKA KOGYO CO.,Ltd. is used.

Figure 17B:
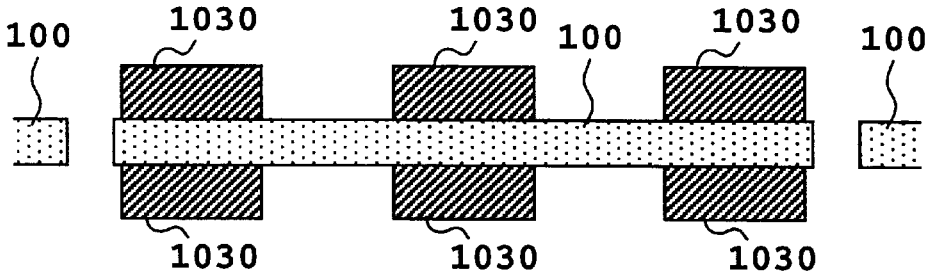

Thereafter, as shown in FIG. 17B, aligning with alignment hole 100*a* of the element substrate 100, exposure was effected by the exposure device (Canon Inc.: MPA-600), then, the resist 1030 at the position to form the second liquid passage is removed. The exposure was performed at the exposure amount of 800 mJ/cm$^2$.

Figure 17C:
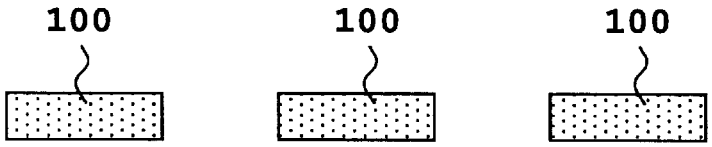

As shown in FIG. 17C, the SUS substrate 100 patterned the resist 103 on both surface was dipped in an etching liquid (aqueous solution of ferric chloride or cupric chloride) to etch out the portion exposed through the resist 103. Then, the resist is removed.

Figure 17D:
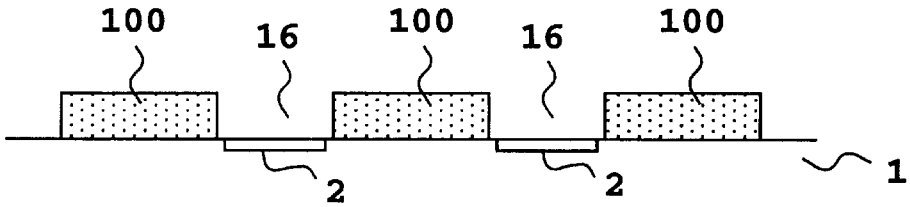

Next, as shown in FIG. 17D, similarly to the former embodiment of the fabrication process, etched SUS substrate 100 was positioned and fixed on the heater board 1 to form the liquid ejection head having the second liquid passage 16 can be assembled.

With the fabrication process of the present embodiment, in addition to the fact that the second liquid passage 16 having high precision with no position error relative to the heater can be obtained, since the liquid passage is formed with SUS, the liquid ejection head holding high reliability with high resistance against alkaline and acid textile inks.

As set forth above, with the present embodiment of the fabrication process, by preliminarily arranging the wall of the second liquid passage on the element substrate 100, it becomes possible to position the electrothermal transducer and the second liquid passage at high precision. Also, for a large number of element substrate before cutting and separating, since the second liquid passages can be formed simultaneously, large amount of the liquid ejection heads can be provided at low cost.

In the liquid ejection head obtained by implementation of the shown embodiment of the fabrication process of the liquid ejection head, since the heater 2 and the second liquid passage are position at high precision, it can be efficiently received the pressure of bubbling by heating of the electrothermal transducer to attain superior ejection efficiency.

The textile printing apparatus is generally used for industry. In the ink-jet textile printing apparatus employing the ink-jet system, down-sizing is possible in viewpoint of construction. The ink-jet textile printing apparatus which can perform image formation even for relatively small cloth, should have sufficient convenience in use in apparel industry. If further down-sizing can be achieved, it may be applicable for personal use to perform textile printing. Thus, demand for down-sizing of the apparatus is strong. In order to achieve down-sizing of the apparatus, a technology for making the ink supply system compact is quite important. For realizing this, application of the technology used in the printer employing the ink-jet system is also important.

Hereinafter, as specific embodiment of the liquid ejection apparatus to be employed for personal use, a construction of a liquid ejection head cartridge, in which a liquid container storing the liquid and the liquid ejection head for ejecting the liquid are integrated, and the construction of the liquid ejection apparatus will be described.

<Liquid Ejecting Head Cartage>

Figure 18:
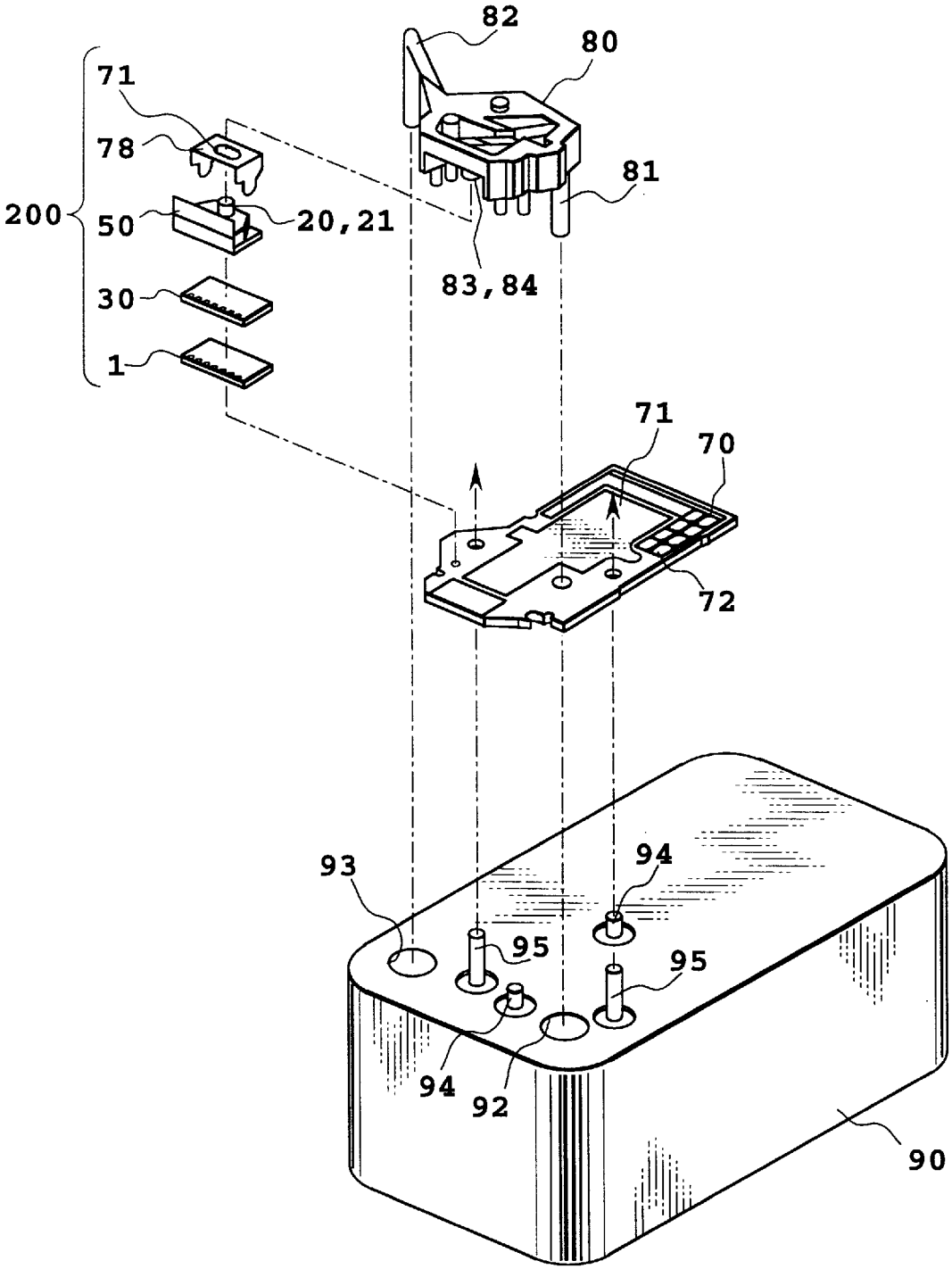
FIG. 18 is an exploded perspective view of a liquid ejection head cartridge.

FIG. 18 is a diagrammatic exploded perspective view of the liquid ejecting head cartridge including the liquid ejecting head. The liquid ejecting head cartridge is generated constructed with a liquid ejecting head portion 200 and a liquid container 80.

The liquid ejecting head portion 200 is constructed with the element substrate 1, the separation wall 30, the grooved member 50, the set spring 78, the liquid supply member 90, a support body 70 and so on. On the element substrate 1, a plurality of heating resistors for applying a heat on the second textile ink as set forth above are provided in a form of array. Also, a plurality of functional device for selectively driving the heating resistors are provided. Between the element substrate 1 and the above mentioned separation wall 30 having the movable member, the second liquid passage is formed for flow of the second textile ink. By mating the separation wall 30 with the grooved upper plate 50, the ejection liquid passage (not shown) for flowing the textile ink can be formed.

The set spring 78 is a member for applying an actuation force to the grooved member 50 in the direction toward the element substrate 1. By this biasing force, the element substrate 1, the separation wall 30 and the groove member 50 can be integrated with the support body 70 discussed later.

The support body 70 is adapted to support the element substrate 1 or so on. On the support body 70, the printing circuit board 71 connected to the element substrate 1 and supplying the electric circuit to the former, and a contact pad 72 for performing exchange the electric signal with the apparatus, are provided.

The liquid container 90 separately stores the first textile ink for supplying to the liquid ejection head, and the second textile ink for generating bubble. On the outside of the liquid container 90, a positioning portion 94 for arranging the connecting member for connection between the liquid ejecting head and the liquid container and a fixing shaft 95 for fixing the connecting portion are provided. Supply of the ejection liquid is performed from a first textile ink supply passage 92 of the liquid container 90 to the first textile ink supply passage 81 of the liquid supply member 80 via the supply passage 84 of the connecting member, and then supplied to the first common liquid chamber via the first textile ink supply passages 83, 71 and 21 of respective members. Similarly, the second textile ink is supplied from the supply passage 93 of the liquid container to the second textile ink supply passage 82 of the liquid supply member 80 via the supply passage of the connecting member, and then supplied to the second liquid chamber via the second textile ink supply passages 84, 71 and 22.

The liquid container 90 may be used by re-filling the textile inks after consuming out respective textile inks. Therefore, it is desirable to provide a liquid inlet for the liquid container 90. The liquid ejection head and the liquid container may be integral, or in the alternative, separable.

<Liquid Ejecting Apparatus>

Figure 19:
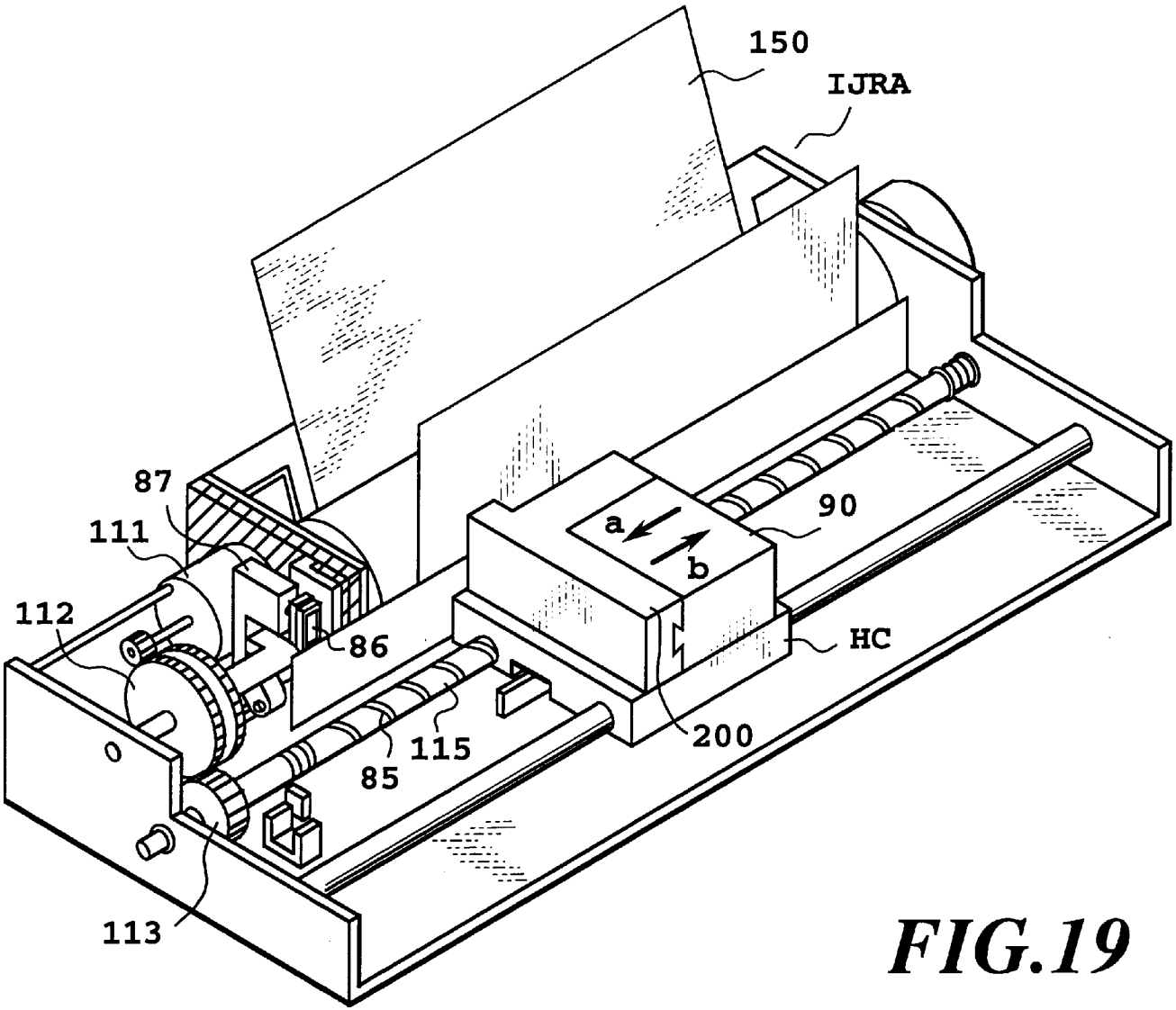
FIG. 19 is a perspective view showing general construction of a liquid ejection apparatus.

FIG. 19 generally shows a liquid ejecting apparatus mounting the foregoing liquid ejection head. The carriage HC of the shown embodiment of the printing apparatus employing the textile ink, is reciprocally movable along a lead screw 85. On the carriage HC, a head cartridge, in which the liquid tank portion 90 storing the ink and the liquid ejection head portion 200 are detachably mounted, is roaded. The carriage HC is movable in the width direction of the cloth 150, such as the blended cloth fed by a cloth feeding means.

When a drive signal is supplied from a not shown drive signal supply means to the liquid ejecting means on the carriage HC, the textile inks are ejected from the liquid ejecting head toward the blended cloth depending upon the drive signal. In FIG. 19, the reference numeral 86 denotes a cap member for capping the front face of the liquid ejection head, and 87 denotes a suction means for suction within the cap member 86. The liquid ejection head is prevented from plugging by subjecting to the suction recovery by the cap member and the suction means.

In the present embodiment of the liquid ejecting apparatus, there are provided a motor 11 as a driving source for driving the cloth feeding means and the carriage, gears 112 and 113 for transmitting the driving force of the driving source to the carriage, a carriage shaft 115 and so on. By this printing apparatus, good image printing product can be obtained by ejecting the textile ink toward various blended cloth.

Figure 20:
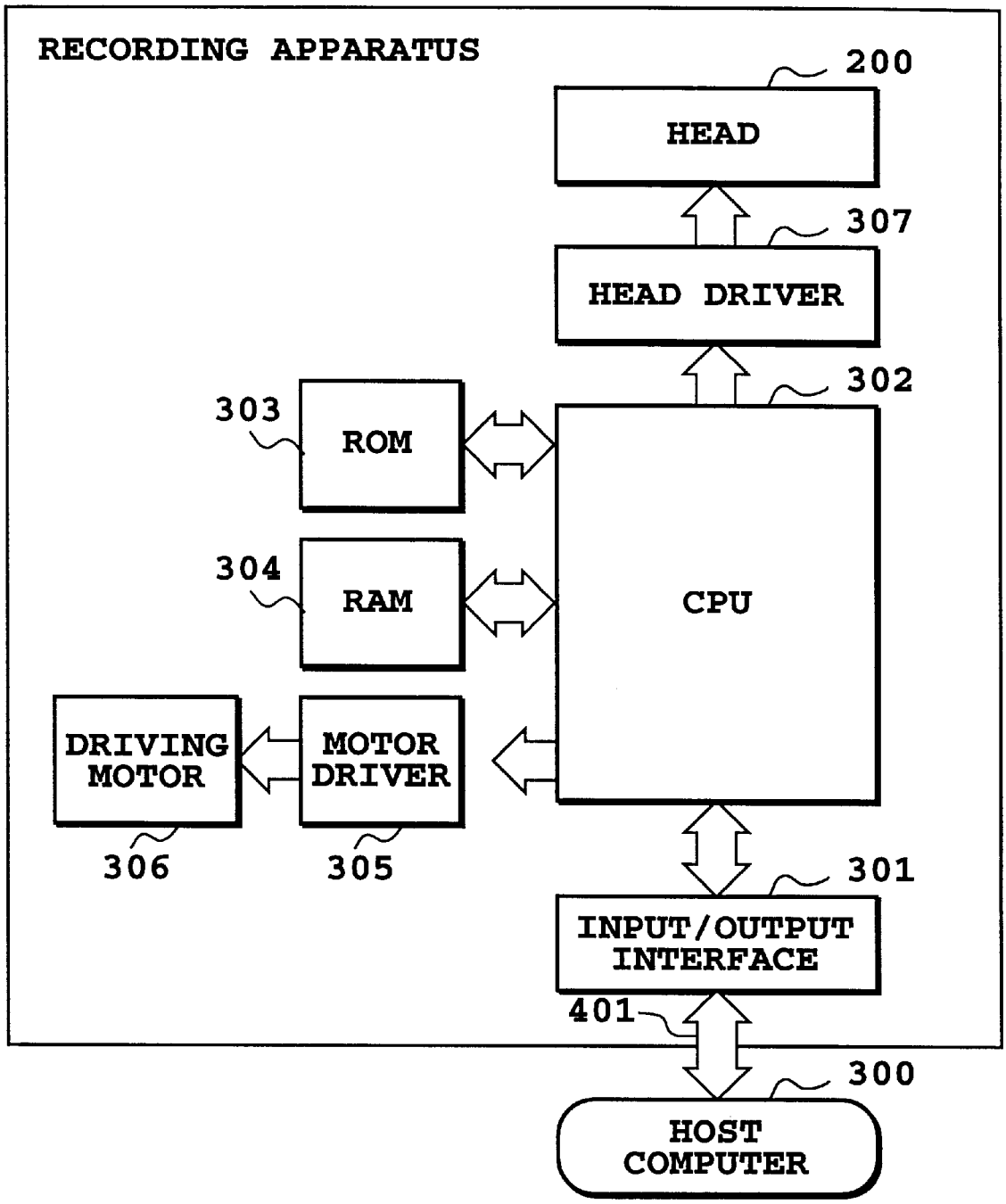
FIG. 20 is a block diagram of the apparatus.

FIG. 20 is a block diagram of the overall apparatus for operating the ink-jet printing, to which the textile ink ejection method according to the present invention is applied.

The printing apparatus receives a printing information from a host computer 300 as a control signal. The printing information is temporarily stored in an input interface 301 in the printing apparatus, and in conjunction therewith, converted into data to be practicable in the printing apparatus and then input to a CPU 302 which, in turn, serves as head driving signal supply means. The CPU 302 processes the input data using RAM 304 and other peripheral units on the basis of the control program stored in a ROM 303 to convert into the printing data (image data).

The CPU 302 generates a drive data for driving the driving motor for moving the printing cloth and the printing head in synchronism with the image data so that the image data may be printed at appropriate position on the printing cloth. The driving data and the motor driving data are transmitted to respective of head 200 and the driving motor 306 via a head driver 307 and a motor driver 305 for driving them at respective controlled timing to form the image.

In FIG. 20 as set forth above, among the major components of the present invention as explained with reference to FIG. 25, means for setting the condition of the cloth and control means for performing ejection with mixing a plurality of textile inks are not illustrated. In FIG. 20, setting of the blending condition is performed by a host computer 300 connected to the printing apparatus, through an I/O interface 301. Also, by making reference to a driving condition setting table stored in ROM 303 on the basis of the set blending condition, the driving condition adapted to the blended cloth can be set.

Figure 28:
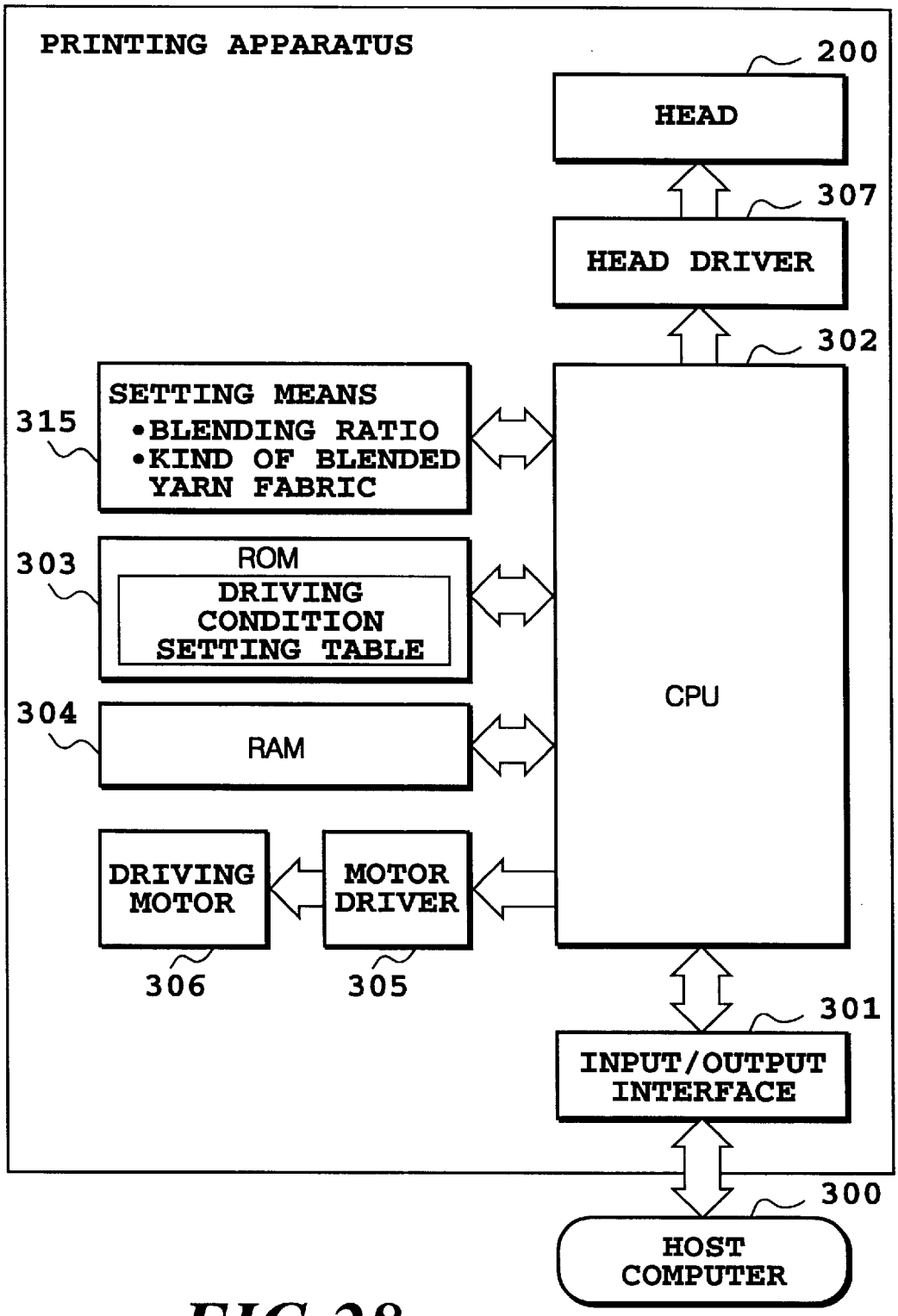
FIG. 28 is a block diagram showing the print apparatus.

Next, one example of the overall apparatus incorporating the major components of the present invention as illustrated in FIG. 25, is shown in a form of block diagram in FIG. 28. In FIG. 28, setting means 315 for setting the composition ratio of the fibers forming the blended cloth and kinds of the fibers forming the blended cloth, is provided. The setting means 315 corresponds to the material setting means 311 and the blending ratio setting means 310 among the components illustrated in FIG. 25. In the construction shown in FIG. 28, CPU 302 sets the driving condition for driving the head 200 by making reference to the driving condition setting table stored in ROM 303 on the basis of the blending condition set by the setting means 315. Concerning the set driving condition, it is also possible to store in RAM 304. Also, the condition of the blended fibers forming the cloth may be set by the host computer in the similar matter to that in FIG. 20. In this case, setting of the driving condition may be performed by selecting one of the condition set by the host computer 300 or the condition set by the setting means 315. In the alternative, either of the condition set by the host computer 300 or the condition set by the setting means 315 may be preferentially used for setting the driving condition.

<Printing System>

Next, one embodiment of an ink-jet printing system to perform printing for the blended cloth with employing the liquid ejecting head according to the present invention as the printing head.

Figure 21:
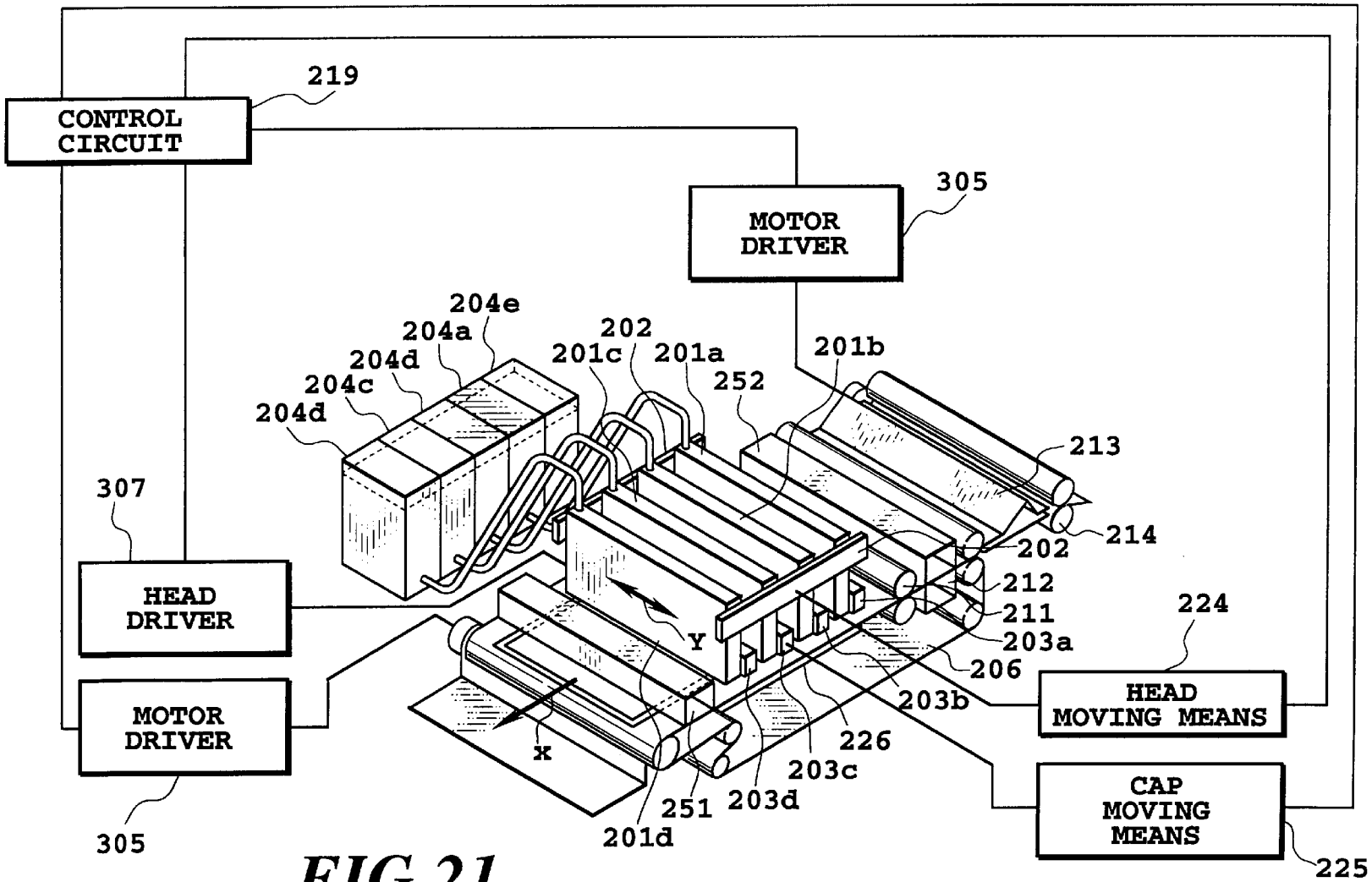
FIG. 21 is a conceptual illustration showing a printing system.

FIG. 21 is a diagrammatic illustration for explaining the construction of the ink-jet printing system employing the foregoing liquid ejection head 201 according to the present invention. The liquid ejection heads 201*a* to 201*d* in the shown embodiment is a full line type, in which a plurality of ejection ports are arranged in an interval of 360 dpi over the length corresponding to a printable width of the blended cloth 150. Namely, the ejection ports are arranged over the entire width of the printing region of the blended cloth (Y direction in the drawing). Four heads 201*a* to 201*d* corresponding to four colors of yellow (Y), magenta (M), cyan (C) and black (Bk) are fixed in parallel to each other with a predetermined interval in the X direction.

With respect to these heads 201*a* to 201*d*, signal is supplied from the head driver 307 forming respective driving signal supply means. On the basis of this signal, respective heads 201*a* to 201*d* are driven.

For respective heads 201*a* to 201*d*, four colors of inks of Y, M, C and Bk as first textile ink are supplied from ink containers 204*a* to 204*d*, The reference numeral 204*e* denotes a second textile ink container storing the second textile ink. From this container 204*e*, the second textile ink is supplied to each head 201*a* to 201*d*.

At lower side of each head 201*a* to 201*d*, head caps 203*a* to 203*d*, in which ink absorbing member, such as sponge or so forth is arranged, are provided for maintenance of the heads 201*a* to 201*d* by covering the ejection ports of respective heads 201*a* to 201*d* during non-printing.

The reference numeral 206 denotes a feeding belt forming the feeding means for feeding the various blended cloth. The feeding belt 206 runs across a predetermined path defined by various rollers, and is driven by the driving motor connected to the motor driver 305.

In the present embodiment of the ink-jet printing system, before and after printing, a pre-treatment device 251 and a post-treatment device 252 for performing various process for the blended cloth are provided upstream and downstream of the printing cloth feeding path.

Content of the pre-treatment and the post-treatment are differentiated depending upon kind of the printing cloth and kind of the textile ink. For example, irradiation of ultraviolet and ozone is performed by pre-treatment to improve adhesion ability of the ink textile by activating the surface. Also, in the printing cloth easily cause static electricity, dust can easily deposit on the surface of the printing cloth by static electricity to obstruct high quality printing. As pre-process, static electricity of the printing cloth is removed by ionizer device and whereby dust is removed from the printing cloth. Also, in viewpoint of prevention of bleeding of the cloth, improvement of fixing rate, a material selected from alkaline material, water soluble material, synthetic high polymer, water soluble metal salt, urea and thiourea may be applied to the cloth for pre-treatment. The pre-treatment is not limited to these treatment but can be the treatment for adjusting the temperature of the blended cloth to the appropriate temperature.

The post-treatment may be a heat-treatment for the blended cloth, for which the ink is applied, a fixing treatment for promoting fixing of the ink textile by irradiation of ultraviolet ray or the like, treatment for washing the treatment liquid applied in the pre-treatment and left non-reacted.

Figure 22:
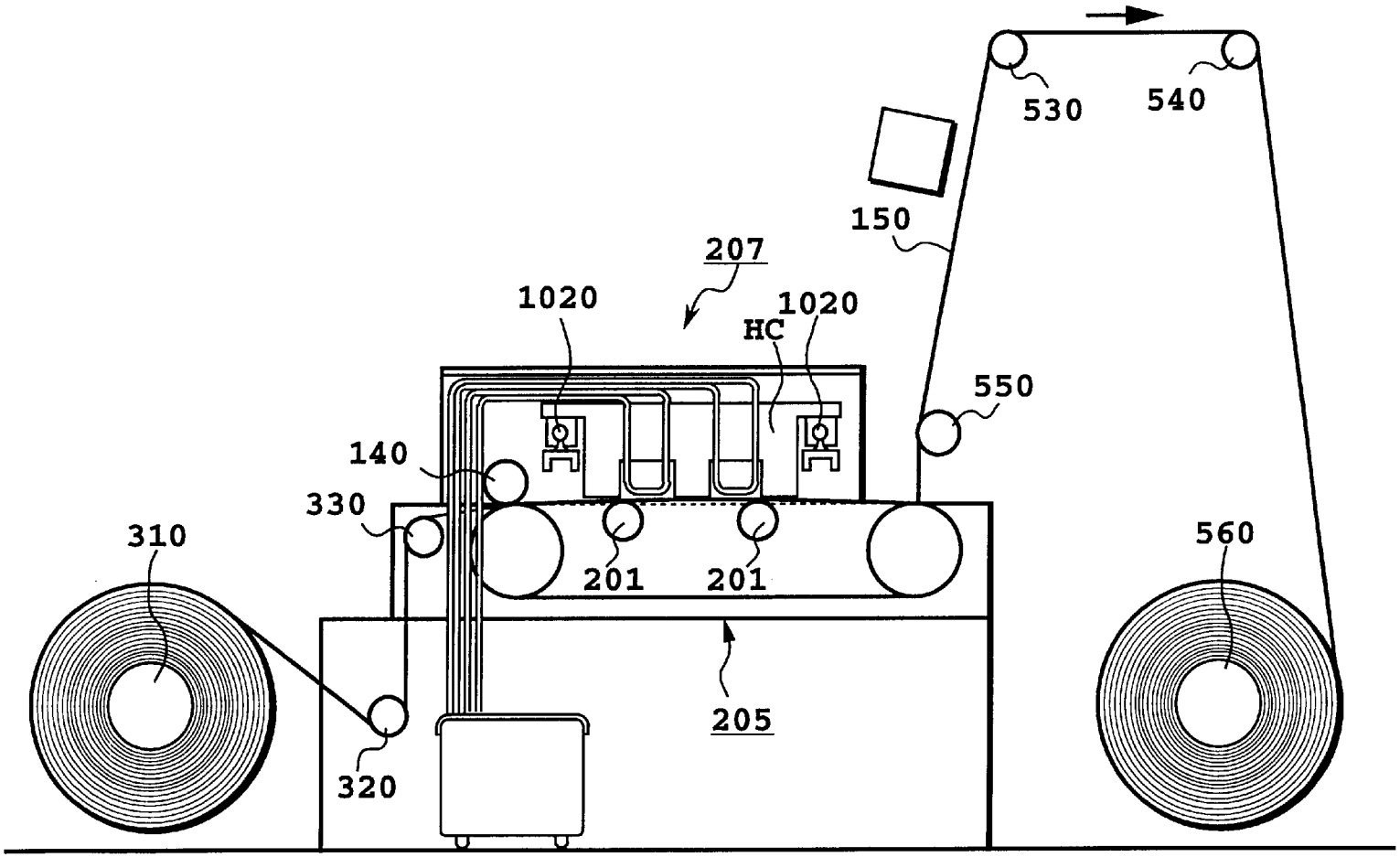
FIG. 22 is a conceptual illustration of another embodiment of a printing system.

FIG. 22 is a diagrammatic sectional side elevation showing the general construction of the textile printing system implementing the ink-jet textile printing method according to the invention.

Here, 150 denotes a blended yarn fabric cloth as the printing medium, which is wound off according to rotation of a feeder roller 310 driven by a not shown motor to reach a feeding means 205 via intermediate rollers 320 and 330.

The feeding means 205 is provided at a portion opposing to a printing portion 207. The blended cloth is horizontally transported by the feeding means 205, and then taken up by a take-up roller 560 via a feeding roller 140 and intermediate rollers 550, 530 and 540.

Figure 23:
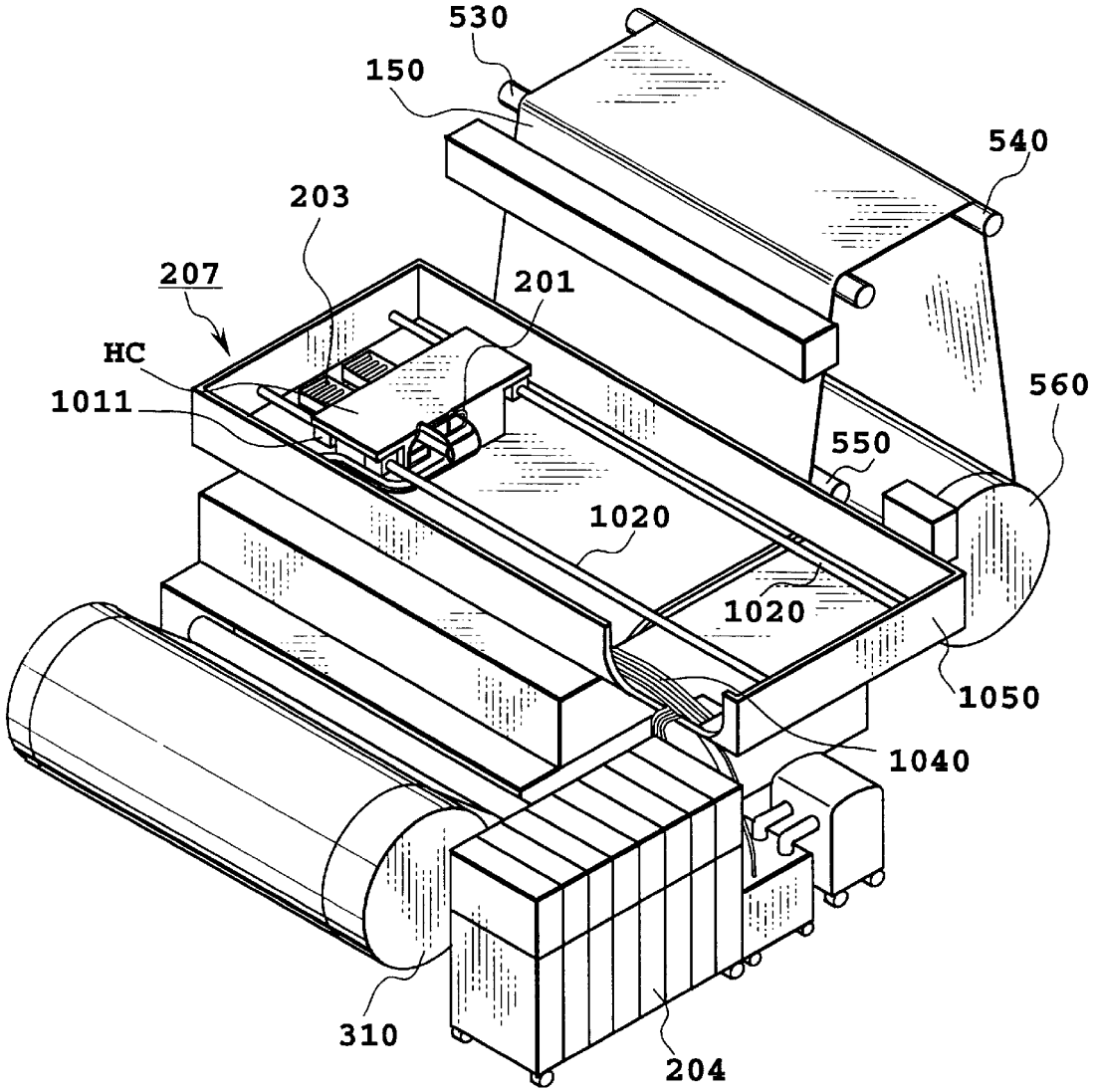
FIG. 23 is a perspective view showing an external appearance of the printing system shown in FIG. 22.

FIG. 23 is a general perspective view of the textile printing system. Within the frame body 1050, a pair of parallel guide rails 1020 are arranged in a primary scanning direction perpendicular to the feeding direction of the blended cloth 150. On these guide rails 1020, a head carriage HC is mounted via ball bearings 1011. By this, the head carriage HC can reciprocally move in the primary scanning direction. The head carriage HC is driven by a driving belt (not shown) by a driving motor (not shown) fixed on one side wall of the frame 1050. On the lower surface of the inside of the head carriage HC, a head unit 1101 for forming the image for the blended cloth 150.

In the liquid ejection head unit, a plurality of the liquid ejection head 201, in each of which a plurality of ejection ports are arranged in the predetermined direction, are held is the direction different from the foregoing predetermined direction, to form one set. Also, in the shown embodiment, the two sets of the liquid ejection heads 201 are held in two stages along the feeding direction. In each set, the liquid ejection heads 201 respectively corresponding to respectively different colors of the textile printing inks, are provided. Thereby, color printing becomes possible.

For the ink-jet head 201, various textile ink is supplied via respective relay tubes 1040 as the ink supply passage from the ink storage tank 204, if necessary. Detail of the ink supply passage will be explained later. These ink supply passages are moved similarly to the carriage HC. Therefore, for facilitating movement and for preventing damaging, these are arranged within a cable bare.

At the lower portion of the home position of the liquid ejection head unit, the head caps 203 are provided. The head caps 203 are adapted to contact with the ejection port forming surface of respective printing heads 201 during non-printing state. In the non-printing state, each printing head 201 is moved to the home position to oppose to the head cap 203. Then, capping is performed. When the liquid ejection head 201 is exposed to the ambient air for a long period, evaporation of the textile ink within the liquid passage is caused to increase viscosity to make ejection unstable. In order to prevent this, during non-printing state, the liquid passage is shielded from the ambient air and sealed. Within the head cap 203, the absorbing member held in wet condition by the textile ink is disposed to maintain the interior of the head cap 203 in highly wetted condition to minimize increasing of the viscosity of the textile ink.

<Head Kit>

A head kit having the liquid ejection head will be described hereinafter. The head kit is effective when the ink-jet textile printing apparatus is employed for personal use. When the remaining ink amount becomes small, the user may easily fill the ink, and printing can be resumes quickly.

Figure 24:
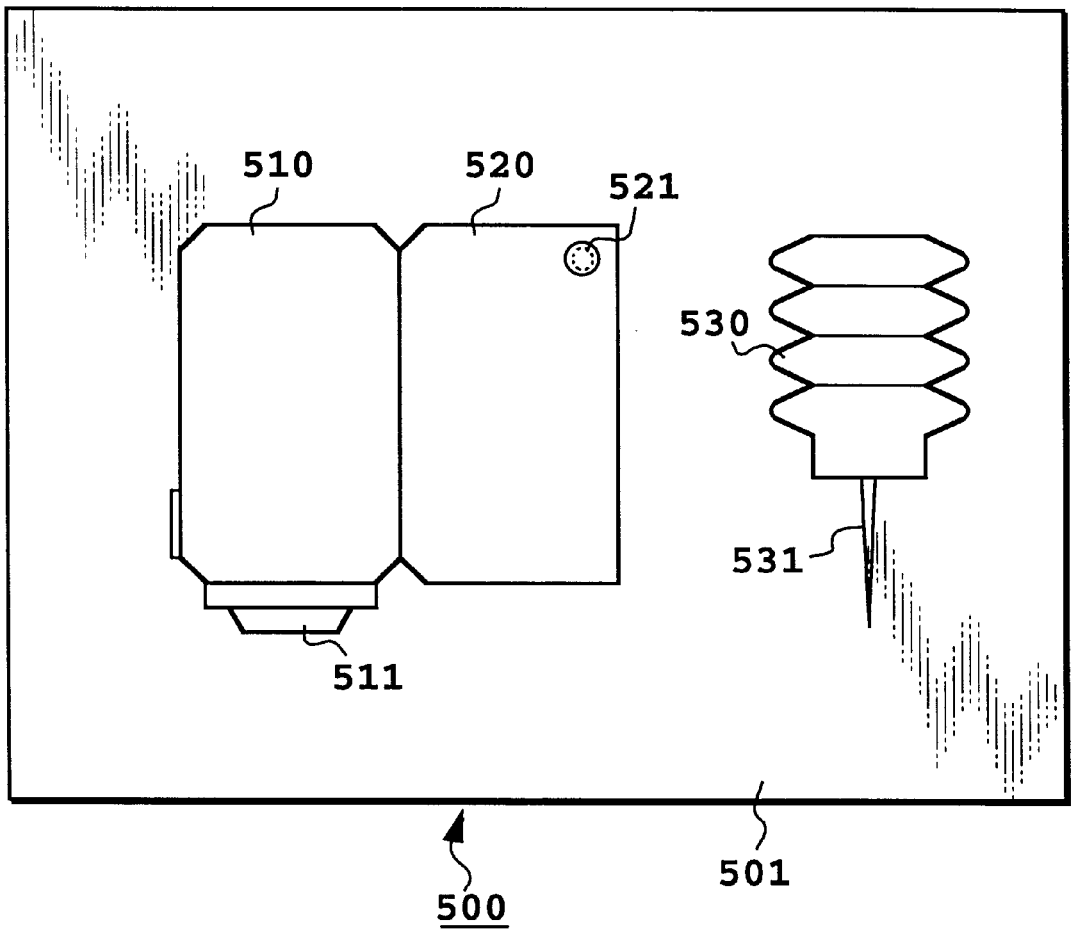
FIG. 24 is a diagrammatic illustration of a head kit.

FIG. 24 is a diagrammatic illustration showing such head kit 500. The head kit 500 is constructed by housing a head 510 according to the present invention having ink ejection portion 511 for ejecting the textile ink, an ink container 520 as a liquid container according to the present invention inseparable or separable relative to the head, an ink filling means storing the textile ink to be filled in the ink container 520, within a kit casing 501.

When the textile ink is consumed out, a part (injection needle or the like) of the ink filling means is inserted through an atmosphere communication opening 521 of the ink container 520, connecting portion of the head 510 or a hole formed through the wall of the ink container 520, to fill the textile ink in the ink filling means through the inserting portion 531.

Thus, by forming the kit by housing the liquid ejecting head 510 of the present invention, the ink container 520, the ink filling means and so on within the kit casing 501, even when the textile ink is consumed out, the textile ink can be filled within the ink container 520 to quickly start printing.

In the present embodiment of the head kit, explanation has been given for the kit 500, in which the ink filling means is included. However, the head kit may be the type in which the detachable ink container 520 filled with the textile ink and the head 510 are housed within the kit casing 501, without including the ink filling means.

In FIG. 24, only ink filling means filling the ink to the textile ink container 520 is shown. However, it can be the type which additionally house a second textile ink filling means for filling the second textile ink in the second textile ink container, in addition to the ink container 520.

What is claimed is:

1. An ink-jet printing method for forming an image on a printing medium by ejecting ink. comprising:

step of employing a liquid ejection head having a first liquid passage communicated with an ejection port, a second liquid passage having a bubble generating region for generating a bubble in a liquid by applying heat to the liquid, said first and second liquid passages communicating with a common ejection port, and a movable member disposed between said first liquid passage and said bubble generating region, having a free end on the ejection port side, and displacing said free end toward first liquid passage side in response to a pressure generated by a bubble within said bubble generating region for orienting said pressure toward the ejection port side of said first liquid passage;

step of supplying a first ink, having a marking material, in said first liquid passage;

step of supplying a second ink, different from the first ink and also having a marking material, in said second liquid passage;

step of heating and bubbling the second ink supplied to said second liquid passage for ejection through said ejection port together with the first ink supplied to said first liquid passage; and step of controlling a ratio of the first ink and the second ink to be ejected from said ejection port.

2. A ink-jet printing method as claimed in claim 1, wherein the second ink is thermally more stable than the first ink.

3. An ink-jet printing method as claimed in claim 1, wherein the printing medium consists of two kinds of materials, the first ink is an ink adapted to the material having a greater proportion among the materials forming the printing medium.

4. An ink-jet printing method as claimed in claim 3, which further comprises:

step of setting a composition ratio of the two kinds of materials; and step of controlling a ratio of the first ink to the second ink to be ejected from said ejection opening, on the basis of set the composition ration.

5. An ink-jet printing method as claimed in claim 1, wherein the printing medium is a cloth, and the first ink and the second ink are textile inks adapted for textile printing.

6. An ink-jet printing method as claimed in claim 5, wherein when the cloth is a blended cloth of at least two kinds of fibers.

7. An ink-jet printing method as claimed in claim 6, which further comprises:

setting step of setting a blending ratio of fibers forming the blended cloth; and step of controlling a mixture ratio of the first ink to the second ink to be ejected from said ejection opening, on a basis of the set blending ratio.

8. An ink-jet printing method as claimed in claim 6, wherein the cloth is a blended yarn fabric of cotton and polyester.

9. An ink-jet printing method as claimed in claim 8, wherein the first ink contains a disperse dye and the second ink contains a water-soluble dye.

10. An ink-jet printing method as claimed in claim 5, wherein when the cloth is a blended yarn fabric of at least two kinds of fibers, the first textile ink corresponds to the fiber having a higher blending ratio among the fibers forming said cloth.

11. An ink-jet printing method as claimed in claim 1, wherein a part of a generated bubble is extended in said first liquid passage in association with displacement of said movable member.

12. An ink-jet printing method as claimed in claim 1, wherein the bubble has a state containing with said movable member during displacement of said movable member.

13. An ink-jet printing method as claimed in claim 1, wherein a heater for heating the second ink so as to generate a bubble is provided in opposition to said movable member, and said bubble generating region is located between said heater and said movable member.

14. An ink-jet printing method as claimed in claim 3, wherein said free end is positioned at a downstream side of flow of the first ink from a center of the area of said heater.

15. An ink-jet printing method as claimed in claim 13, wherein the bubble is generated by film boiling the second ink by heating the second ink by said heater.

16. An ink-jet printing method as claimed in claim 13, wherein, on the heater, said second ink is supplied along a substantially flat or smooth inner peripheral surface at an upstream side of said heater.

17. An ink-jet printing method as claimed in claim 13, wherein an entire effective bubbling region of said heater opposes said movable member.

18. An ink-jet printing method as claimed in claim 13, wherein an entire surface of said heater opposes said movable member.

19. An ink-jet printing method as claimed in claim 13, wherein a fulcrum of said movable member is not positioned right above said heater.

20. An ink-jet printing method as claimed in claim 13, wherein said free end of said movable member is arranged on more of an ejection port side than said heater.

21. An ink-jet printing apparatus for forming an image on a printing medium by ejecting ink comprising:

first and second liquid passages corresponding to a common ejection opening for ejecting the ink;

a liquid ejection head constructed to eject a first ink, having a marking material, supplied from said first liquid passage and a second ink, different from the first ink and also having a marking material, supplied from said second liquid passage through the common ejection opening; and mixture ratio control means for controlling a mixture ratio of said first ink to said second ink to be ejected from the common ejection opening of the printing head.

22. An ink-jet printing apparatus as claimed in claim 21, wherein the printing medium consists of two kinds of materials.

23. An ink-jet printing apparatus as claimed in claim 22, which further comprises:

setting means for setting a composition ratio of the two kinds of materials;

wherein said mixture ratio control means controls a ratio of the first ink to the second ink to be ejected from said ejection opening, based on the composition ratio set by said setting means.

24. An ink-jet printing apparatus as claimed in claim 21, wherein the printing medium is a cloth and the first ink and the second ink are textile inks adapted for textile printing.

25. An ink-jet printing apparatus as claimed in claim 24, wherein the cloth is a blended cloth of at least two kinds of fibers.

26. An ink-jet printing apparatus as claimed in claim 25, which further comprises:

setting means for setting a blending ratio of fibers forming the cloth; and wherein said mixture ratio control means controls a ratio of the first ink to the second ink to be ejected from said ejection opening, on a basis of the blending ratio set by said setting means.

27. An ink-jet printing apparatus as claimed in claim 21, wherein said setting means can also set materials of the fibers forming the cloth.

28. An ink-jet printing apparatus as claimed in claim 21, wherein said mixture ratio control means controls the mixture ratio of inks by modifying driving condition of the liquid ejection head.

29. An ink-jet printing apparatus as claimed in claim 21, wherein said liquid ejection head comprises a first liquid passage communicated with an ejection port, a second liquid passage having a bubble generating region for generating a bubble in a liquid by applying heat to the liquid, and a movable member disposed between said first liquid passage and said bubble generating region, having a free end on the ejection port side, and displacing said free end toward said first liquid passage side in response to a pressure generated by a bubble within said bubble generating region for orienting the pressure toward the ejection port side of said first liquid passage.

* * * * *

UNITED STATES PATENT AND TRADEMARK OFFICE

CERTIFICATE OF CORRECTION

PATENT NO. : 6,302,519 B1
DATED : October 16, 2001
INVENTOR(S) : Shizuko Fukuda et al.

It is certified that error appears in the above-identified patent and that said Letters Patent is hereby corrected as shown below:

Title page,
Item [56], References Cited, FOREIGN PATENT DOCUMENTS,
"640479 * 3/1995 (EP)" (first occurrence) should be deleted.
Item [57], ABSTRACT,
Line 4, "head" should read -- heads --.

Column 1,
Line 16, "screen" should read -- and screen --;
Line 19, "a" (second occurrence) should be deleted;
Line 20, "printing" (second occurrence) should read -- print --;
Line 23, "corresponds" should read -- corresponding --;
Line 36, "require" should read -- is required --;
Line 39, "has" should read -- have --;
Line 40, "toward" should read -- in --;
Line 60, "supplied" should read -- supplying --; and
Line 62, "supplied" should read -- supplying --.

Column 2,
Line 2, "as" should read -- are --;
Line 10, "i.e.," should read -- i.e., --;
Line 11, "i.e." should read -- i.e., --.
Line 16, "property" should read -- properties --;
Line 24, "complicate" should read -- complicated --;
Line 49, "comprises;" should read -- comprises:-- and
Line 67, "ejected" should read -- being ejected --.

Column 3,
Line 13, "of" should read -- of the --;
Line 23, "flow" should read -- the flow --;
Line 25, "cause" should read -- is caused --;
Line 27, "the" should read -- that the --;
Line 38, "invention," should read -- invention --;
Line 56, "must" should read -- had to --; and
Line 66, "be" should read -- the --.

Column 4,
Line 13, "another" should read -- other --;
Line 24, "position" should read -- a position --; and
Line 65, "is" should read -- is an --.

UNITED STATES PATENT AND TRADEMARK OFFICE

CERTIFICATE OF CORRECTION

PATENT NO. : 6,302,519 B1
DATED : October 16, 2001
INVENTOR(S) : Shizuko Fukuda et al.

It is certified that error appears in the above-identified patent and that said Letters Patent is hereby corrected as shown below:

Column 5,
Line 12, "observe" should read -- observing of --;
Line 13, "example" should read -- example of --;
Line 28, "supply" should read -- supplying --; and
Line 31, "supply" should read -- supplying --.

Column 6,
Line 29, "continues" should read -- continuous --.

Column 8,
Line 7, "is" should read -- is an --;
Line 8, "above mentioned" should read -- above-mentioned --;
Line 19, "arranged." should read -- is arranged. --;
Line 26, "prevent" should read -- prevents --; and
Line 35, "re-fill" should read -- refill --.

Column 10,
Line 20, "in fluctuation" should be deleted; and
Line 64, "associating" should read -- associated --.

Column 11,
Line 19, "FIG. 8 is" should read -- FIG. 8A and 9B are --.

Column 12,
Line 39, "be" should be deleted; and
Line 62, "device," should read -- devices, --.

Column 13,
Line 7, "ejection" (first occurrence) should read -- ejected --;
Line 19, "keep" should read -- will keep --;
Line 22, "is" should be deleted; and
Line 50, "arranged" should read -- is arranged --.

Column 14,
Line 12, "above mentioned" should read -- above-mentioned --;
Line 18, "the" (second occurrence) should be deleted;
Line 33, "the to" should be deleted;
Line 41, "cross sectional" should read -- cross-sectional --;
Line 54, "is" should read -- in --; and
Line 64, "results" should read -- result --.

UNITED STATES PATENT AND TRADEMARK OFFICE

CERTIFICATE OF CORRECTION

PATENT NO. : 6,302,519 B1
DATED : October 16, 2001
INVENTOR(S) : Shizuko Fukuda et al.

It is certified that error appears in the above-identified patent and that said Letters Patent is hereby corrected as shown below:

Column 15,
Line 55, "disperse" should read -- dispersed --;
Line 67, "disperse" should read -- dispersed --.

Column 16,
Line 5, "contact" should read -- in contact --; and
Line 57, "to" should be deleted.

Column 17,
Line 41, "to" should be deleted; and
Line 44, "goes end" should read -- ends --.

Column 18,
Line 8, "made," should read -- made. --

Column 19,
Line 19, "INC.:" should read -- Inc.: --; and
Line 30, "way" should read -- ray --.

Column 20,
Line 11, "invention," should read -- invention. --;
Line 62, "surface" should red -- surfaces --; and
Line 65, "CO.,Ltd." should read -- CO., Ltd. --.

Column 21,
Line 5, "patterned" should read -- patterned on --;
Line 33, "position" should read -- positioned --;
Line 38, "viewpoint" should read -- view --; and
Line 59, "constructed" should read -- having been constructed --.

Column 22,
Line 2, "above mentioned" should read -- above-mentioned --;
Line 18, "exchange" should read -- the exchange of --; and
Line 52, "roaded" should read -- loaded --.

Column 24,
Line 18, "204d," should read -- 204d. --.

UNITED STATES PATENT AND TRADEMARK OFFICE

CERTIFICATE OF CORRECTION

PATENT NO. : 6,302,519 B1
DATED : October 16, 2001
INVENTOR(S) : Shizuko Fukuda et al.

It is certified that error appears in the above-identified patent and that said Letters Patent is hereby corrected as shown below:

Column 25,
Line 33, "damaging" should read -- damage --; and
Line 56, "resumes" should read -- resumed --.

Column 26,
Line 19, "house" should read -- houses --.

Signed and Sealed this

Second Day of July, 2002

*Attest:*

*Attesting Officer*

JAMES E. ROGAN
*Director of the United States Patent and Trademark Office*